US008207719B2

(12) United States Patent
Shiota

(10) Patent No.: US 8,207,719 B2
(45) Date of Patent: Jun. 26, 2012

(54) SERIES REGULATOR CIRCUIT AND SEMICONDUCTOR INTEGRATED CIRCUIT

(75) Inventor: Tetsuyoshi Shiota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 305 days.

(21) Appl. No.: 12/467,628

(22) Filed: May 18, 2009

(65) Prior Publication Data

US 2009/0322297 A1 Dec. 31, 2009

(30) Foreign Application Priority Data

Jun. 30, 2008 (JP) ..... 2008-171576

(51) Int. Cl.
*G05F 1/563* (2006.01)
*G05F 1/59* (2006.01)

(52) U.S. Cl. ..... 323/266; 323/269; 323/273

(58) Field of Classification Search ..... 323/266, 323/273, 274, 269, 270, 268
See application file for complete search history.

(56) References Cited

U.S. PATENT DOCUMENTS 5,467,009 A * 11/1995 McGlinchey ..... 323/269
5,592,072 A * 1/1997 Brown ..... 323/268
5,945,817 A * 8/1999 Nguyen ..... 323/273
5,956,278 A * 9/1999 Itou ..... 365/201
6,111,395 A * 8/2000 Hirade et al. ..... 323/273
6,265,856 B1 * 7/2001 Cali' et al. ..... 323/273
7,106,032 B2 * 9/2006 Chen et al. ..... 323/269
7,719,242 B2 * 5/2010 Negoro ..... 323/273
2001/0026149 A1 10/2001 Kanakubo
2005/0068092 A1 3/2005 Sano
2006/0148416 A1 7/2006 Harasawa et al.
2006/0164888 A1 * 7/2006 Pisasale et al. ..... 365/185.18
2006/0273767 A1 12/2006 Fujii
2007/0210779 A1 * 9/2007 Itoh ..... 323/284
2008/0079403 A1 * 4/2008 Lipcsei et al. ..... 323/269

FOREIGN PATENT DOCUMENTS

JP 2001-282371 A 10/2001
JP 2003-235250 A 8/2003
JP 2005-107948 A 4/2005
JP 2006-190020 A 7/2006
JP 2006-190021 A 7/2006

* cited by examiner

*Primary Examiner* — Adolf Berhane
*Assistant Examiner* — Fred E Finch, III
(74) *Attorney, Agent, or Firm* — Arent Fox LLP

(57) ABSTRACT

A series regulator circuit includes one or more transistors each having a channel with one end coupled to an input node to receive an input voltage and another end coupled to an output node, and having a control node to receive a control voltage, a control circuit configured to adjust the control voltage in response to a voltage of the output node such that the voltage of the output node is set equal to a voltage setting selected by an output voltage setting signal, and a switch circuit configured to change an operating condition, excluding the control voltage, of the one or more transistors in conjunction with a change in the voltage setting of the output node.

18 Claims, 18 Drawing Sheets

FIG.13

| OUTPUT CURRENT SETTING VALUE | OUTPUT VOLTAGE SETTING VALUE | SW1 | S1 | S2 |
|---|---|---|---|---|
| HIGH CURRENT VALUE | 1.2 V | D2 | VSS | VSS |
| | 0.8 V | D1 | VSS | Vin |
| LOW CURRENT VALUE | 1.2 V | D2 | VSS | Vin |
| | 0.8 V | D1 | Vin | Vin |

FIG.15

| POWER SUPPLY MODE | OUTPUT VOLTAGE SETTING VALUE | SW1 | S1 | S2 |
|---|---|---|---|---|
| POWER ON | 1.2 V | D2 | VSS | VSS |
| | 0.8 V | D1 | VSS | Vin |
| POWER OFF | – | DON'T CARE | Vin | Vin |

SERIES REGULATOR CIRCUIT AND SEMICONDUCTOR INTEGRATED CIRCUIT

CROSS-REFERENCE TO RELATED APPLICATIONS

The present application is based upon and claims the benefit of priority from the prior Japanese Patent Application No. 2008-171576 filed on Jun. 30, 2008, with the Japanese Patent Office, the entire contents of which are incorporated herein by reference.

FIELD

The disclosures herein generally relate to regulator circuits, and particularly relate to a series regulator circuit.

BACKGROUND

It is preferable for semiconductor circuits to have low power consumption in order to prolong the life of batteries for portable equipments and/or to reduce the size of heat sink components of semiconductor devices. For the purpose of reducing power consumption in semiconductor circuits, it is preferable to drive the circuits with a low power supply voltage. A system that uses a switching regulator to reduce a power supply voltage and further uses a series regulator to stabilize the reduced power supply is an effective means to supply a low power supply voltage in an efficient and stable manner.

A series regulator receives an input voltage Vin at one end of the channel of an output transistor, with the other end of the channel coupled to the load as an output terminal. The voltage appearing at this output terminal is an output voltage Vo. A control voltage applied to the control node of the output transistor is adjusted to control the output voltage Vo. In a series regulator circuit, the input voltage Vin is set equal to the sum of the output voltage Vo, a saturation voltage Vdsat of the output transistor, and a margin voltage. If Vo=2 V and Vdsat=0.15 V, for example, Vin is set equal to 2.2 V by taking into account a margin voltage of 0.05V.

A technology that changes the number of last-stage transistors in response to an output current is known to those skilled in the art as a means to stabilize a series regulator. In this configuration, the number of last-stage output transistors is increased in the case of larger current consumption, and is decreased in the case of smaller current consumption. With such an arrangement, the regulator can operate in a stable manner regardless of the amount of an output current.

When further reduction in the power consumption of semiconductor circuits is required in the future, it will be preferable to reduce the power consumption of a series regulator. In order to reduce the power consumption of a series regulator, a voltage difference (Vin−Vo) between the input voltage Vin and the output voltage Vo may need to be reduced. In this case, the output transistor does not operate in the saturation region, but operates in the linear region.

[Patent Document 1] Japanese Patent Application Publication No. 2003-235250

[Patent Document 2] Japanese Patent Application Publication No. 2006-190021

[Patent Document 3] Japanese Patent Application Publication No. 2006-190020

[Patent Document 4] Japanese Patent Application Publication No. 2001-282371

[Patent Document 5] Japanese Patent Application Publication No. 2005-107948

SUMMARY

According to an aspect of the embodiment, a series regulator circuit includes one or more transistors each having a channel with one end coupled to an input node to receive an input voltage and another end coupled to an output node, and having a control node to receive a control voltage, a control circuit configured to adjust the control voltage in response to a voltage of the output node such that the voltage of the output node is set equal to a voltage setting selected by an output voltage setting signal, and a switch circuit configured to change an operating condition, excluding the control voltage, of the one or more transistors in conjunction with a change in the voltage setting of the output node.

According to another aspect, a series regulator circuit includes a switching regulator, and a series regulator configured to receive as an input voltage an output voltage of the switching regulator, wherein the series regulator includes one or more transistors each having a channel with one end coupled to an input node to receive the input voltage and another end coupled to an output node, and having a control node to receive a control voltage, a control circuit configured to adjust the control voltage in response to a voltage of the output node such that the voltage of the output node is set equal to a voltage setting selected by an output voltage setting signal, and a switch circuit configured to change an operating condition, excluding the control voltage, of the one or more transistors in conjunction with a change in the voltage setting of the output node.

According to another aspect, a semiconductor integrated circuit includes a processor configured to operate in one of a plurality of processing modes, and a series regulator configured to supply a power supply voltage to the processor, wherein the series regulator includes one or more transistors each having a channel with one end coupled to an input node to receive an input voltage and another end coupled to an output node, and having a control node to receive a control voltage, a control circuit configured to adjust the control voltage in response to a voltage of the output node such that the voltage of the output node is set equal to a voltage setting responsive to a signal indicating the one of the plurality of processing modes, and a switch circuit configured to change an operating condition, excluding the control voltage, of the one or more transistors in conjunction with a change in the voltage setting of the output node, wherein the power supply voltage is supplied from the output node to the processor.

The object and advantages of the embodiment will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

FIG. 13 is a table illustrating the decoding operations of a decoder circuit;

FIG. 15 is a table illustrating the decoding operations of a decoder circuit;

DESCRIPTION OF EMBODIMENTS

Figure 1:
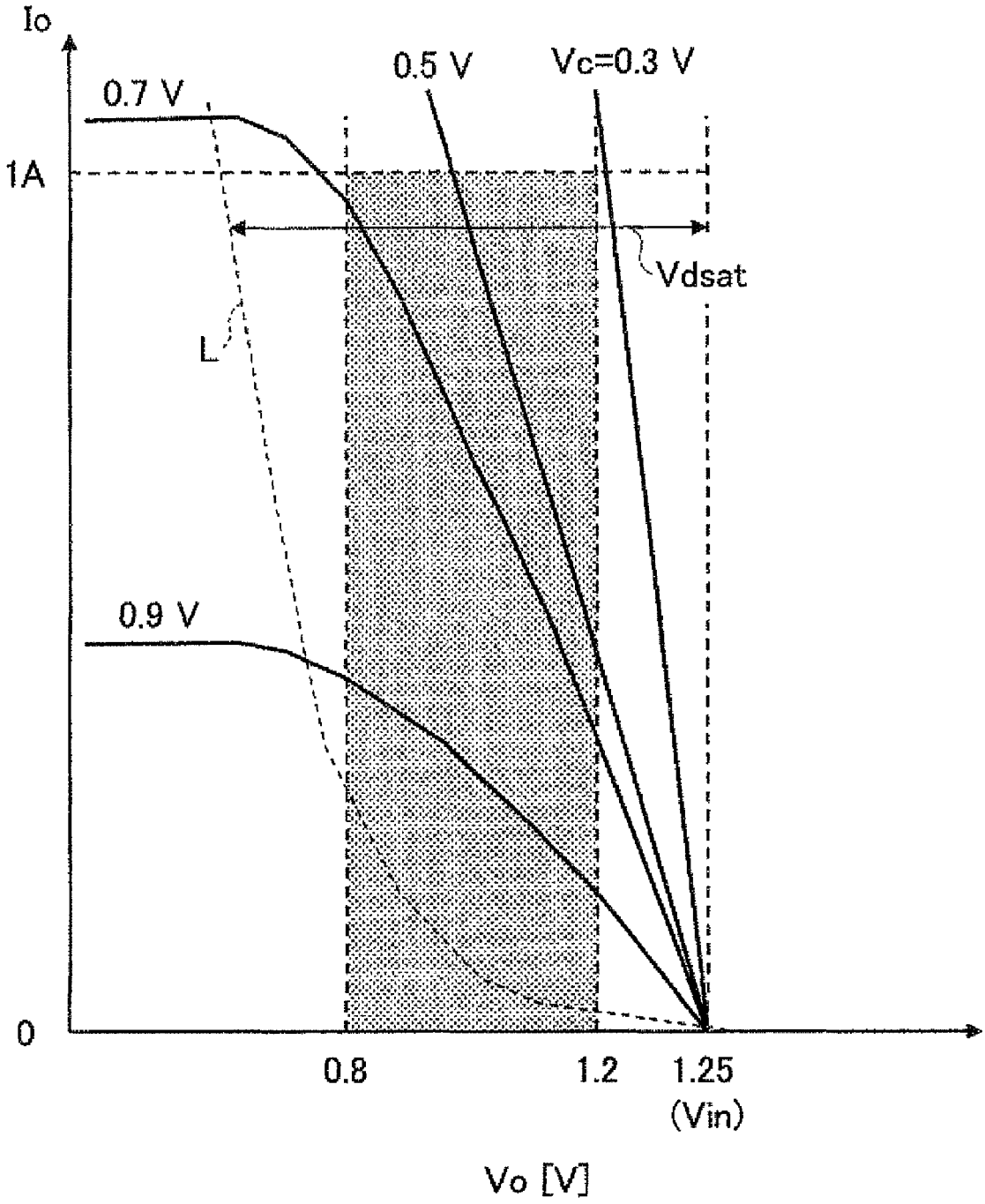
FIG. 1 is a drawing illustrating the operating characteristics of an output transistor of a series regulator circuit that operates in a linear region.

FIG. 1 is a drawing illustrating the operating characteristics of an output transistor of a series regulator circuit that operates in a linear region. The horizontal axis represents an output voltage Vo, and the vertical axis represents an output current Io that is equal to the drain current of the output transistor. The operating characteristics illustrated in FIG. 1 correspond to a case in which a PMOS transistor having a gate width of 5000 micrometers is used as an output transistor, with the input voltage Vin set equal to 1.25 V. When the output current Io is to be 1 A, for example, a voltage Vc applied to the gate node is set equal to approximately 0.3 V in order to set the output voltage Vo to 1.2 V. Similarly, when the output current Io is to be 1 A, the voltage Vc applied to the gate node is set equal to approximately 0.7 V in order to set the output voltage Vo to 0.8 V. In FIG. 1, a dotted line L represents a saturation voltage Vdsat with respect to a given current amount.

The voltage Vc may be set close to the input voltage Vin as in the case of the voltage Vc being 0.7 V. With the output transistor being a PMOS transistor, such a setting may result in the deteriorating stability of the output voltage Vo, as will be described in the following. When a series regulator circuit and a semiconductor circuit receiving its power supply voltage are implemented on a single semiconductor chip, a plurality of output transistors of the series regulator circuit are often arranged at spaced apart locations inside the chip in order to reduce unevenness in voltages at different locations inside the chip. For example, the plurality of output transistors may be situated at the perimeter of the chip so as to surround the circuit receiving the power supply voltage situated at the center of the chip. In this configuration, a control circuit that applies a control voltage to the control nodes (e.g., gate nodes) of the output transistors is provided at a single location. Signal lines to supply the control signal Vc from the control circuit to the respective output transistors thus end up being lengthy, thereby becoming vulnerable to noise that is generated through capacitive coupling between these signal lines and other signal lines.

Figure 2:
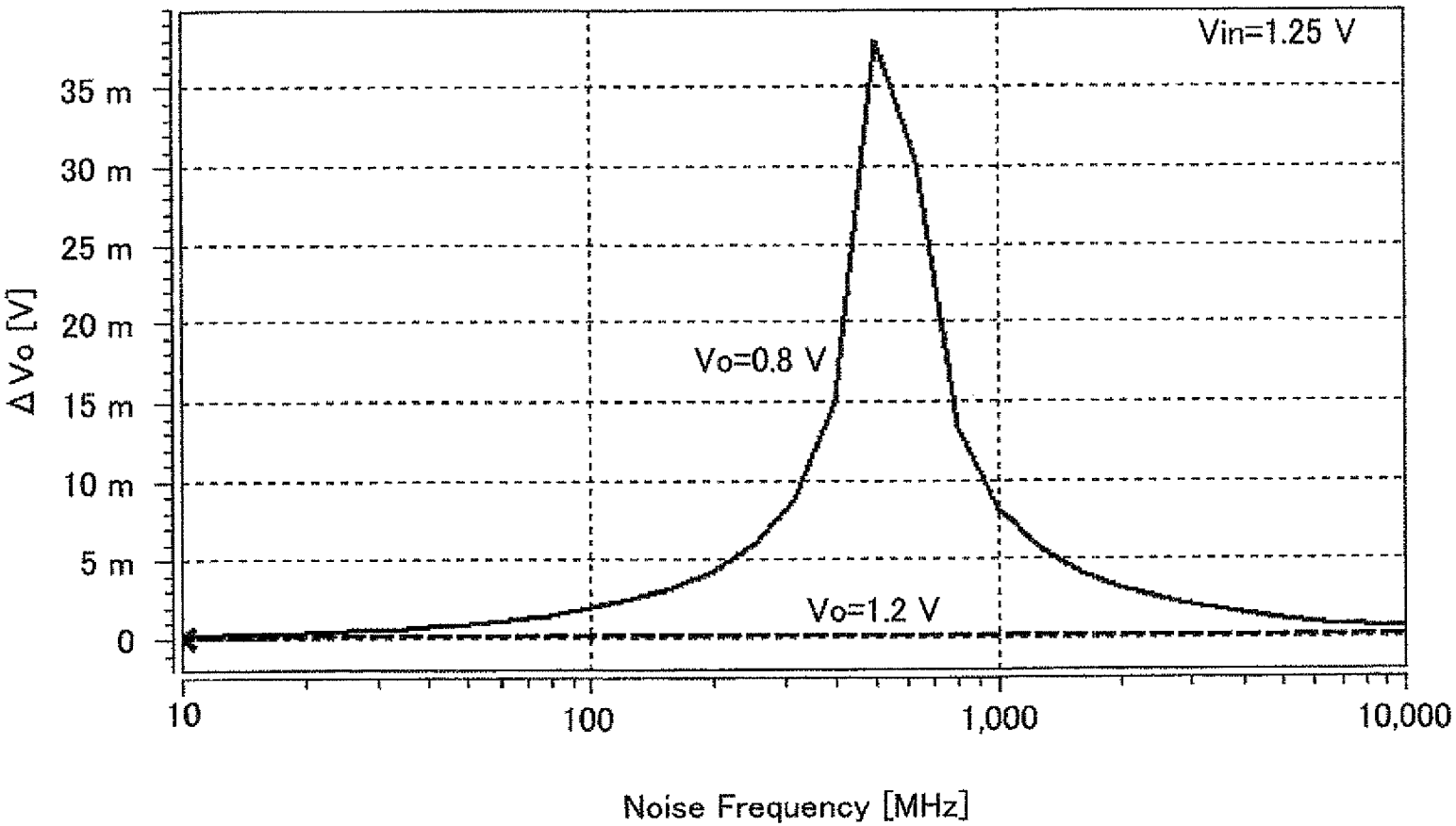
FIG. 2 is a drawing illustrating simulation results that indicate the effect of voltage fluctuation caused by capacitive coupling on output voltage.

FIG. 2 is a drawing illustrating simulation results that indicate the effect of voltage fluctuation caused by capacitive coupling on the output voltage Vo. The control signal line connected to the control node of an output transistor having the operating characteristics illustrated in FIG. 1 is coupled through a capacitive coupling of 10 pF to a noise source that has the potential thereof fluctuating with an amplitude of 100 mV. In FIG. 2, the horizontal axis represents noise source frequency, and the vertical axis represents the magnitude of fluctuation in the output voltage Vo. When the output voltage is to be set equal to 1.2 V as was previously described, the fluctuation of the output voltage resulting from the fluctuation of the control signal Vc caused by the capacitive coupling with noise has a fluctuation magnitude that is smaller than 1 mV regardless of the frequency. When the output voltage is to be set equal to 0.8 V, on the other hand, the fluctuation of the output voltage resulting from the fluctuation of the control signal Vc caused by the capacitive coupling with noise has a fluctuation magnitude that reaches almost 38 mV at some frequency. Such a significant fluctuation of the output voltage may cause malfunction in a circuit that receives the output voltage.

In the following, a description will be given of the mechanism of the phenomenon described above. As is understood from FIG. 1, when the output current Io is to be 1 A, the voltage Vc applied to the gate node is set equal to approximately 0.3 V in order to set the output voltage Vo to 1.2 V. The voltage-current characteristics in the case of the 0.3-V gate voltage have a characteristic curve that is at a great distance from the saturation region and steep in the vicinity of a point at which Io is equal to 1 A and Vo is equal to 1.2 V. It follows that a slight change in the gate voltage Vc does not cause a significant change in the output voltage Vo that makes the output current Io equal to 1 A. On the other hand, when the output current Io is to be 1 A, the voltage Vc applied to the gate node is set equal to approximately 0.7 V in order to set the output voltage Vo to 0.8 V. The voltage-current characteristics in the case of the 0.7-V gate voltage have a characteristic curve that is closer to the saturation region and thus has a gentler slope in the vicinity of a point at which Io is equal to 1 A and Vo is equal to 0.8 V. It follows that a slight change in the gate voltage Vc causes a significant change in the output voltage Vo that makes the output current Io equal to 1 A.

In the following, embodiments of the present invention will be described with reference to the accompanying drawings.

Figure 3:
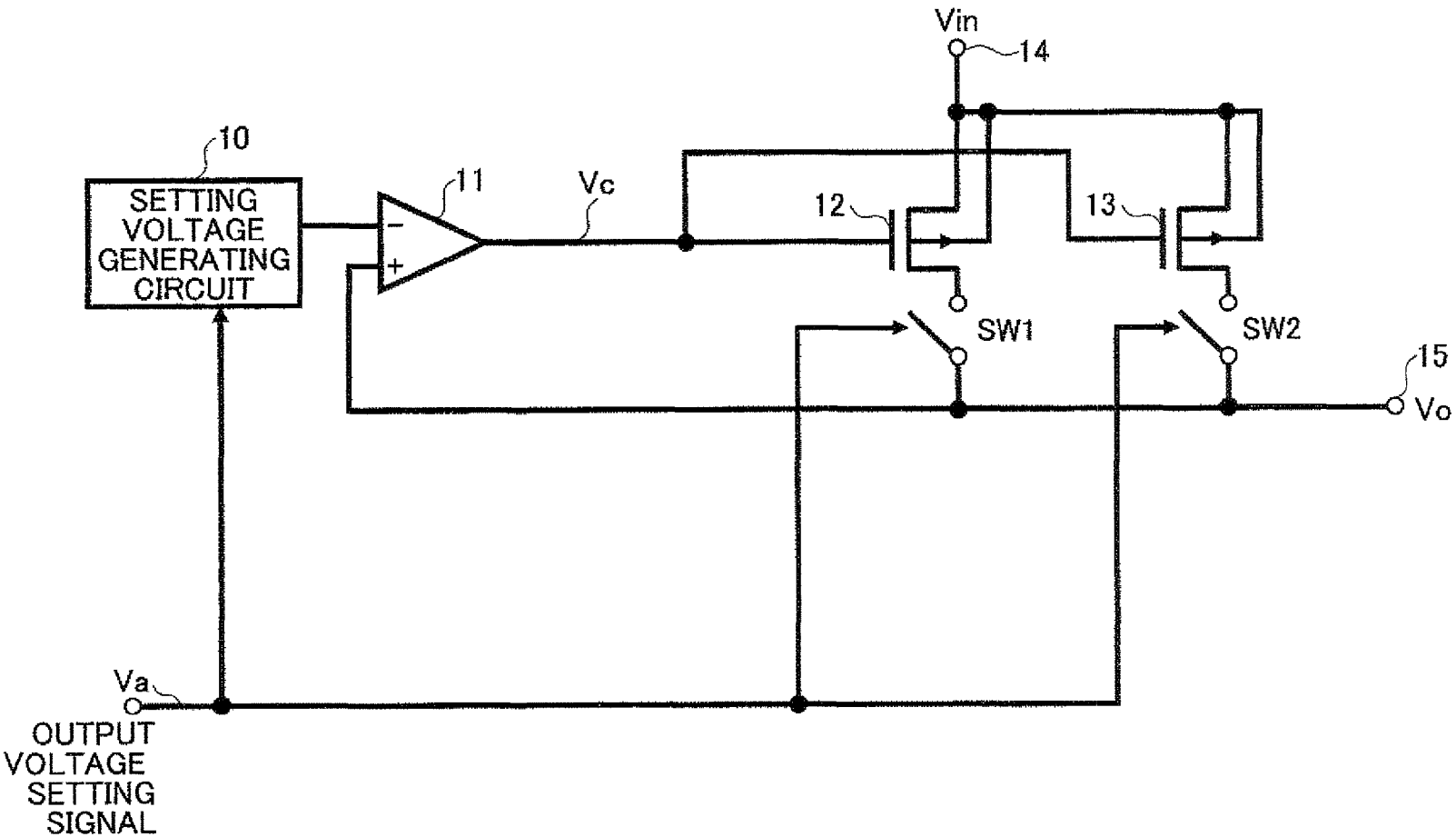
FIG. 3 is a drawing illustrating a basic configuration of a series regulator circuit.

FIG. 3 is a drawing illustrating a basic configuration of a series regulator circuit. The series regulator circuit illustrated in FIG. 3 includes a setting voltage generating circuit 10, an operational amplifier 11, a PMOS transistor 12, a PMOS transistor 13, a switch circuit SW1, and a switch circuit SW2. Each of the PMOS transistors 12 and 13 has a channel with one end thereof coupled to an input node 14 for receiving an input voltage Vin and the other end thereof coupled to an output node 15, and also has a control node (i.e., gate) that receives a control voltage Vc.

The setting voltage generating circuit 10 and the operational amplifier 11 serve as a control circuit to control the output voltage. This control circuit adjusts the control voltage Vc in response to the voltage Vo of the output node 15 such that the voltage at the output node 15 is set equal to a voltage value selected by an output voltage setting signal Va. Specifically, the output voltage Vo is applied to the non-inverted input of the operational amplifier 11, and the inverted input of the operational amplifier 11 receives a reference voltage supplied from the setting voltage generating circuit 10. The setting voltage generating circuit 10 generates this reference voltage in response to the output voltage setting signal Va. For example, the setting voltage generating circuit 10 generates a first reference voltage (e.g., 1.2 V) in the case of the output voltage setting signal Va being equal to a first value, and generates a second reference voltage (e.g., 0.8 V) in the case of the output voltage setting signal Va being equal to a second value. The operational amplifier 11 generates the control voltage Vc as its output voltage responsive to a voltage difference that is obtained by subtracting the reference voltage from the output voltage Vo. The PMOS transistors 12 and 13 are placed in such voltage settings that they operate in the linear region rather than in the saturation region. Vin is equal to 1.25V, and the output voltage Vo is equal to 1.2 V or 0.8 V, for example.

The switch circuits SW1 and SW2 serve as a switch circuit to change operating conditions, excluding the control voltage Vc, of the one or more transistors (i.e., PMOS transistors 12 and 13 in the example illustrated in FIG. 3) in conjunction with a change in the setting of a voltage value of the output node 15. To be more exact, the switch circuit changes operating conditions, excluding the control voltage Vc and the drain voltage (i.e., the voltage at the output node 15), of the one or more transistors in conjunction with a change in the setting of a voltage value of the output node 15. The switch circuit may change the operating conditions of the one or more transistors excluding the control voltage Vc in response to the output voltage setting signal Va. Alternatively, a voltage detector may be provided to generate a detection signal responsive to the voltage Vo at the output node 15 as will be described later, and the switch circuit may change the operating conditions of the one or more transistors excluding the control voltage Vc in response to the detection signal. Namely, the conductive and nonconductive states of the switch circuits SW1 and SW2 may be controlled based on the detection signal.

The switch circuit may switch transistors to supply a current to the output node 15 among the one or more transistors depending on whether the output voltage setting signal Va assumes the first value or the second value. Namely, the switch circuits SW1 and SW2 in the configuration of FIG. 3 are placed in the conductive state and the nonconductive state, respectively, in response to the output voltage setting signal Va being equal to the first value. The PMOS transistor 12 thus supplies an output current to the output node 15. The switch circuits SW1 and SW2 are placed in the nonconductive state and the conductive state, respectively, in response to the output voltage setting signal Va being equal to the second value. In this case, the PMOS transistor 13 supplies an output current to the output node 15.

Alternatively, the switch circuit may change the numbers of transistors supplying a current to the output node 15 among the one or more transistors, depending on whether the output voltage setting signal Va assumes the first value or the second value. Namely, the switch circuits SW1 and SW2 in the configuration of FIG. 3 are both placed in the conductive state in response to the output voltage setting signal Va being equal to the first value. The PMOS transistors 12 and 13 thus supply an output current to the output node 15. Further, only one of the switch circuits SW1 and SW2 is placed in the conductive state in response to the output voltage setting signal Va being equal to the second value. In this case, one of the PMOS transistors 12 and 13 supplies an output current to the output node 15.

In any one of the arrangements described above, the gate widths W of the transistors are set such that the control voltage Vc is sustained at its present voltage as much as possible without exhibiting a change in such a direction as to cause an increase in channel resistance, i.e., in such a direction as to cause each transistor to be increasingly nonconductive, in response to the lowering of a setting value of the output voltage Vo. Namely, the gate widths W of the transistors are set such that the control voltage Vc does not rise in response to the lowering of a setting value of the output voltage Vo in the case of the transistor being a PMOS transistor. If the output voltage Vo is set equal to 1.2 V in response to the output voltage setting signal Va being the first value, for example, the control voltage Vc may need to be set to 0.3 V in order to supply an output current of 1 A. In this case, provision is made such that when the output voltage Vo is set equal to 0.8 V in response to the output voltage setting signal Va being the second value, the control voltage Vc is still set to 0.3 V in order to supply an output current of 1 A. If the control voltage Vc is set to a higher voltage such as 0.7 V, for example, the output voltage Vo undesirably exhibits significant fluctuation in response to a noise affecting the control voltage Vc, as was previously described in connection with FIG. 1. It is thus preferable to keep a voltage difference between the gate and the source as large as possible, i.e., to keep the control voltage Vc as low as possible in the case of a PMOS transistor.

In more general terms, the following can be said. A change in the control voltage Vc that keeps the current supplied to the output node 15 constant despite a change in the voltage setting of the output node 15 is denoted as ΔVc when the operating conditions, excluding the control voltage Vc, of the one or more transistors are not changed by the switch circuit. In the configuration illustrated in FIG. 3, the switch circuit may change the operating conditions, other than the control voltage Vc, of the one or more transistors. With this arrangement, the change in the control voltage that keeps the current supplied to the output node 15 constant despite a change in the voltage setting of the output node 15 is made smaller than ΔVc. Specifically, an increase in the control voltage that keeps the current supplied to the output node 15 constant despite a drop in the voltage setting of the output node 15 is made smaller than ΔVc. As was previously noted, further, it is preferable to keep the control voltage Vc as low as possible in the case of a PMOS transistor.

As an example, the PMOS transistor 12 may be chosen to supply an output current to the output node 15 when the voltage setting of the output voltage Vo is Vo1 (e.g., 1.2 V), and the PMOS transistor 13 may be chosen to supply an output current to the output node 15 when the voltage setting of the output voltage Vo is Vo2 (e.g., 0.8 V). Further, each of the PMOS transistors 12 and 13 has a threshold voltage Vth, a gate length L, a channel mobility μeff, and a per-unit-area gate capacitance Cox. The gate width of the PMOS transistor 12 is W1, and the gate width of the PMOS transistor 13 is W2. In such a case, a current flowing through the PMOS transistor 12 when the voltage setting of the output voltage Vo is Vo1 (e.g., 1.2 V) is represented as follows.

$$Ids(M1) = \frac{W1}{L}\mu_{eff}C_{ox}\left((Vin - Vc - Vth)(Vin - Vo1) - \frac{1}{2}(Vin - Vo1)^2\right)$$

A current flowing through the PMOS transistor 13 when the voltage setting of the output voltage Vo is Vo2 (e.g., 0.8 V) smaller than Vo1 is represented as follows.

$$Ids(M2) = \frac{W2}{L}\mu_{eff}C_{ox}\left((Vin - Vc - Vth)(Vin - Vo2) - \frac{1}{2}(Vin - Vo2)^2\right)$$

By setting Ids(M1) equal to Ids(M2), a ratio of W1 to W2 is obtained as follows.

$$W1:W2 = \left((Vin - Vc - Vth)(Vin - Vo1) - \frac{1}{2}(Vin - Vo1)^2\right):\left((Vin - Vc - Vth)(Vin - Vo2) - \frac{1}{2}(Vin - Vo2)^2\right)$$

Accordingly, the PMOS transistors 12 and 13 may be designed to satisfy the above-noted radio so that the control voltage Vc is substantially the same between the case of the output voltage Vo being Vo1 (e.g., 1.2 V) and the case of the output voltage Vo being Vo2 (e.g., 0.8V). Namely, the control voltage Vc is sustained at a low voltage level, thereby keeping a voltage difference between the gate and the source as large as possible.

With the above-described configuration, the control voltage applied to the output transistor to provide a constant output current regardless of an output voltage setting can be maintained at a constant voltage level at which the influence of noise is relatively small. Fluctuation in the output voltage Vo can thus be kept small even when the control voltage fluctuates due to capacitive coupling and the like.

Figure 4:
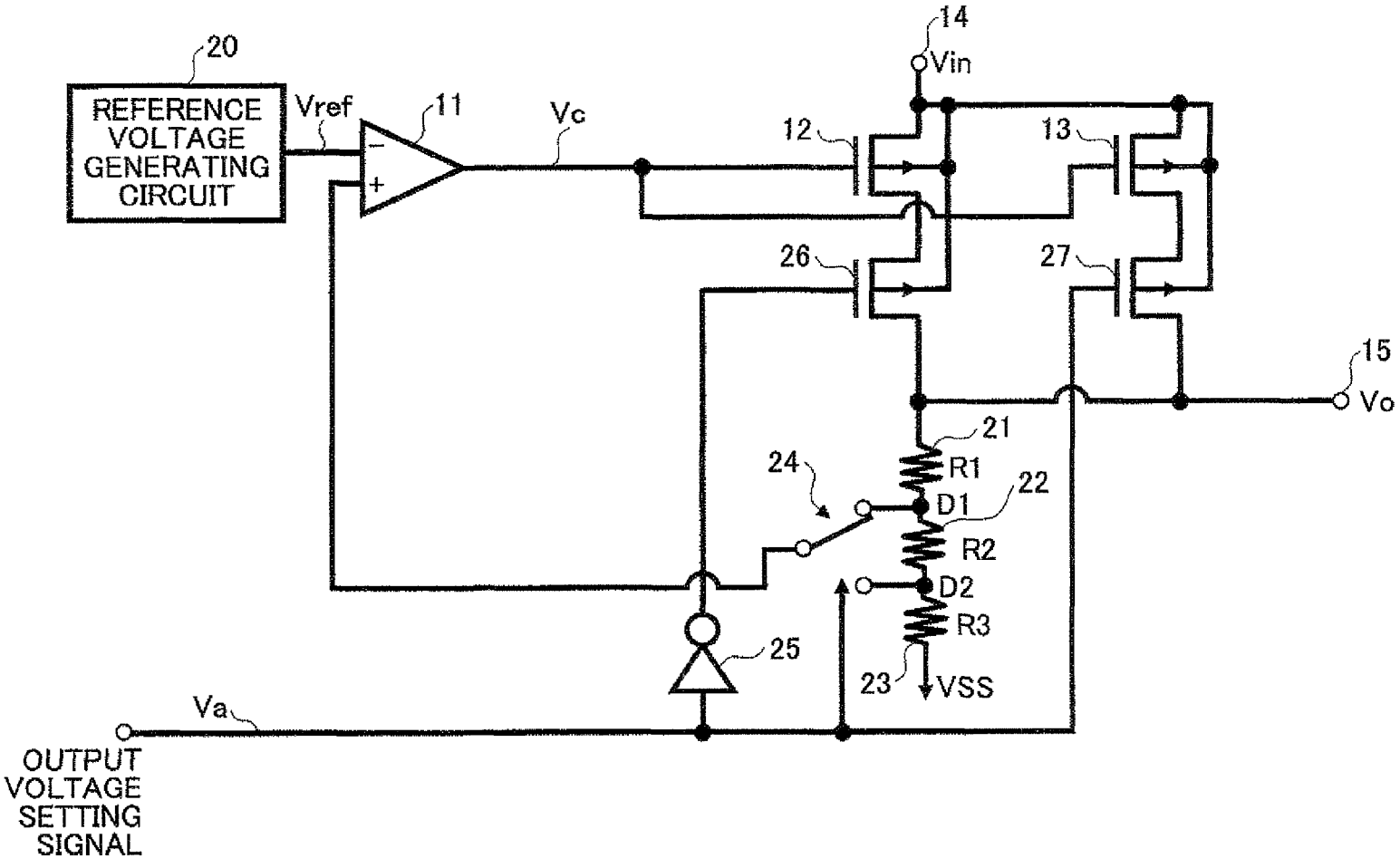
FIG. 4 is a drawing illustrating an embodiment of the series regulator circuit illustrated in FIG. 3.

FIG. 4 is a drawing illustrating an embodiment of the series regulator circuit illustrated in FIG. 3. In FIG. 4, the same elements as those of FIG. 3 are referred to by the same numerals, and a description thereof will be omitted. In the series regulator circuit illustrated in FIG. 4, PMOS transistors 26 and 27 are used as switch circuits SW1 and SW2 of FIG. 3, respectively. An inverted signal of the output voltage setting signal Va is applied to the gate of the PMOS transistor 26 via an inverter 25, and the output voltage setting signal Va is applied to the gate of the PMOS transistor 27. The configuration illustrated in FIG. 3 is such that the output voltage Vo is compared by the operational amplifier 11 with the reference voltage generated by the setting voltage generating circuit 10. In the configuration illustrated in FIG. 4, on the other hand, a voltage obtained by dividing the output voltage Vo is compared by the operational amplifier 11 with the reference voltage generated by a reference voltage generating circuit 20. A potential divider includes resistors 21 through 23 and a switch circuit 24. The resistors 21, 22, and 23 have resistance values R1, R2, and R3, respectively. The connection node of the switch circuit 24 is selectively coupled to either a node D1 or a node D2 in response to the output voltage setting signal Va, thereby supplying a selected divided voltage to the non-inverted input of the operational amplifier 11.

When the output voltage setting signal Va is equal to the first value (i.e., HIGH which is equal to power supply voltage Vin), for example, the node D2 is selected so that VoR3/(R1+R2+R3) is supplied to the non-inverted input of the operational amplifier 11. In this case, the output voltage Vo is set equal to the high voltage Vo1 (e.g., 1.2 V). When the output voltage setting signal Va is equal to the second value (i.e., LOW which is equal to a ground voltage VSS), the node D1 is selected so that Vo(R2+R3)/(R1+R2+R3) is supplied to the non-inverted input of the operational amplifier 11. In this case, the output voltage Vo is set equal to the low voltage Vo2 (e.g., 0.8 V).

When the voltage setting of the output voltage Vo is Vo1 (e.g., 1.2 V), the PMOS transistor 12 is chosen as the transistor to supply an output current to the output node 15. When the voltage setting of the output voltage Vo is Vo2 (e.g., 0.8 V), the PMOS transistor 13 is chosen as the transistor to supply an output current to the output node 15. A current flowing through the PMOS transistor 12 when the voltage setting of the output voltage Vo is Vo1 (e.g., 1.2 V) is represented as follows.

$$Ids(M1) = \frac{W1}{L}\mu_{eff}C_{ox}\left((Vin - Vc - Vth)\left(Vin - Vref\frac{R1 + R2 + R3}{R1}\right) - \frac{1}{2}\left(Vin - Vref\frac{R1 + R2 + R3}{R1}\right)^2\right)$$

A current flowing through the PMOS transistor 13 when the voltage setting of the output voltage Vo is Vo2 (e.g., 0.8 V) smaller than Vo1 is represented as follows.

$$Ids(M2) = \frac{W2}{L}\mu_{eff}C_{ox}\left((Vin - Vc - Vth)\left(Vin - Vref\frac{R1 + R2 + R3}{R1 + R2}\right) - \frac{1}{2}\left(Vin - Vref\frac{R1 + R2 + R3}{R1 + R2}\right)^2\right)$$

By setting Ids(M1) equal to Ids(M2), a ratio of W1 to W2 is obtained as follows.

$$W1:W2 = \left((Vin - Vc - Vth)\left(Vin - Vref\frac{R1 + R2 + R3}{R1}\right) - \frac{1}{2}\left(Vin - Vref\frac{R1 + R2 + R3}{R1}\right)^2\right):\left((Vin - Vc - Vth)\left(Vin - Vref\frac{R1 + R2 + R3}{R1 + R2}\right) - \frac{1}{2}\left(Vin - Vref\frac{R1 + R2 + R3}{R1 + R2}\right)^2\right)$$

Accordingly, the PMOS transistors 12 and 13 may be designed to satisfy the above-noted radio so that the control voltage Vc is substantially the same between the case of the output voltage Vo being Vo1 (e.g., 1.2 V) and the case of the output voltage Vo being Vo2 (e.g., 0.8 V). Namely, the control voltage Vc is sustained at a low voltage level, thereby keeping a voltage difference between the gate and the source as large as possible. Since the PMOS transistors 26 and 27 simply function as switches, PMOS transistors having a gate width sufficiently wider than the previously-noted widths W1 and W2 may properly be used.

Figure 5:
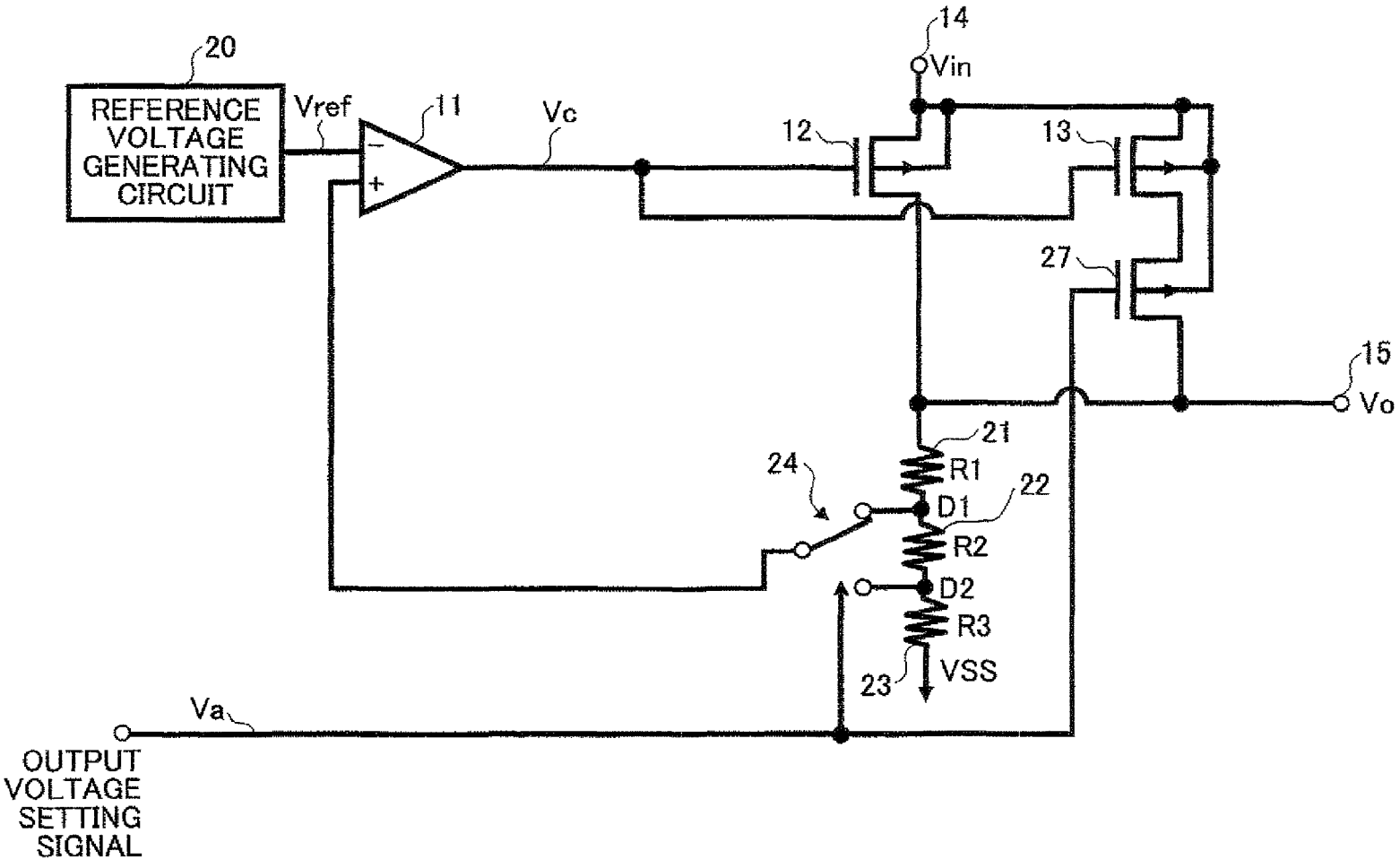
FIG. 5 is a drawing illustrating a variation of the series regulator circuit illustrated in FIG. 4.

FIG. 5 is a drawing illustrating a variation of the series regulator circuit illustrated in FIG. 4. In FIG. 5, the same elements as those of FIG. 3 and FIG. 4 are referred to by the same numerals, and a description thereof will be omitted. In the series regulator circuit illustrated in FIG. 5, when the voltage setting of the output voltage Vo is Vo1 (e.g., 1.2 V), the PMOS transistor 27 becomes conductive so that the PMOS transistors 12 and 13 supply an output current to the output node 15. When the voltage setting of the output voltage Vo is Vo2 (e.g., 0.8 V), on the other hand, the PMOS transistor 27 becomes nonconductive so that only the PMOS transistor 12 supplies an output current to the output node 15. When the output voltage setting signal Va is equal to the first value (i.e., LOW which is equal to the ground voltage VSS), the node D2 is selected so that VoR3/(R1+R2+R3) is supplied to the non-inverted input of the operational amplifier 11. In this case, the output voltage Vo is set equal to the high voltage Vo1 (e.g., 1.2 V). When the output voltage setting signal Va is equal to the second value (i.e., HIGH which is equal to the power supply voltage Vin), the node D1 is selected so that Vo(R2+R3)/(R1+R2+R3) is supplied to the non-inverted input of the operational amplifier 11. In this case, the output voltage Vo is set equal to the low voltage Vo2 (e.g., 0.8 V).

In the case described above, a ratio of a gate width W1' of the PMOS transistor 12 to a gate width W2' of the PMOS transistor 13 can be obtained based on a ratio of W1 to W2 obtained for the configuration illustrated in FIG. 4 by use of the following equation: W1'+W2':W2'=W1:W2. The PMOS transistors 12 and 13 may be designed to satisfy this equation so that the control voltage Vc is substantially the same between the case of the output voltage Vo being Vo1 (e.g., 1.2 V) and the case of the output voltage Vo being Vo2 (e.g., 0.8V). Namely, the control voltage Vc is sustained at a low voltage level, thereby keeping a voltage difference between the gate and the source as large as possible.

Figure 6:
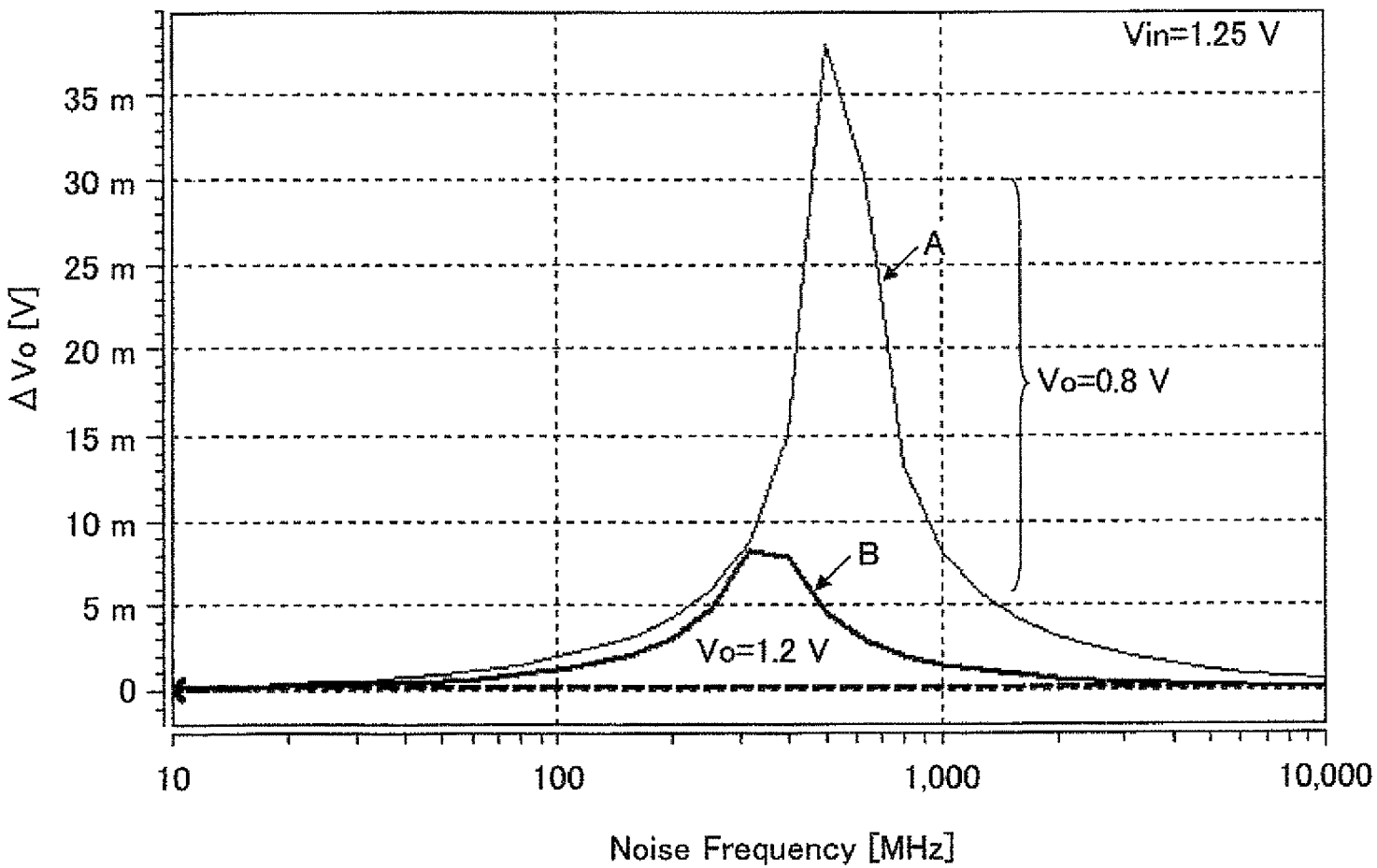
FIG. 6 is a drawing illustrating simulation results that indicate the effect of voltage fluctuation caused by capacitive coupling on output voltage.

FIG. 6 is a drawing illustrating simulation results that indicate the effect of voltage fluctuation caused by capacitive coupling on the output voltage Vo. Similarly to the manner described in connection with FIG. 2, the control signal line connected to the control node of a transistor are coupled through a capacitive coupling of 10 pF to a noise source that has the potential thereof fluctuating with an amplitude of 100 mV. When the output voltage is to be set equal to 1.2 V, the fluctuation of the output voltage resulting from the fluctuation of the control signal Vc caused by the capacitive coupling with noise has a fluctuation magnitude that is smaller than 1 mV regardless of the frequency. A characteristic curve A is the same as the characteristic curve illustrated in FIG. 2, and corresponds to the characteristics observed when the control voltage Vc is changed to maintain the output voltage at 0.8 V. In this case, the fluctuation of the output voltage resulting from the fluctuation of the control signal Vc caused by the capacitive coupling with noise has a fluctuation magnitude that reaches almost 38 mV at some frequency. A characteristic curve B, on the other hand, corresponds to characteristics observed when the configuration illustrated in FIG. 4 or FIG. 5 is used to maintain the output voltage at 0.8 V while keeping the control voltage Vc at the constant voltage level. In this example, the voltage fluctuation of the output voltage Vo is suppressed below 8 mV even when the output voltage is set equal to 0.8 V.

Figure 7:
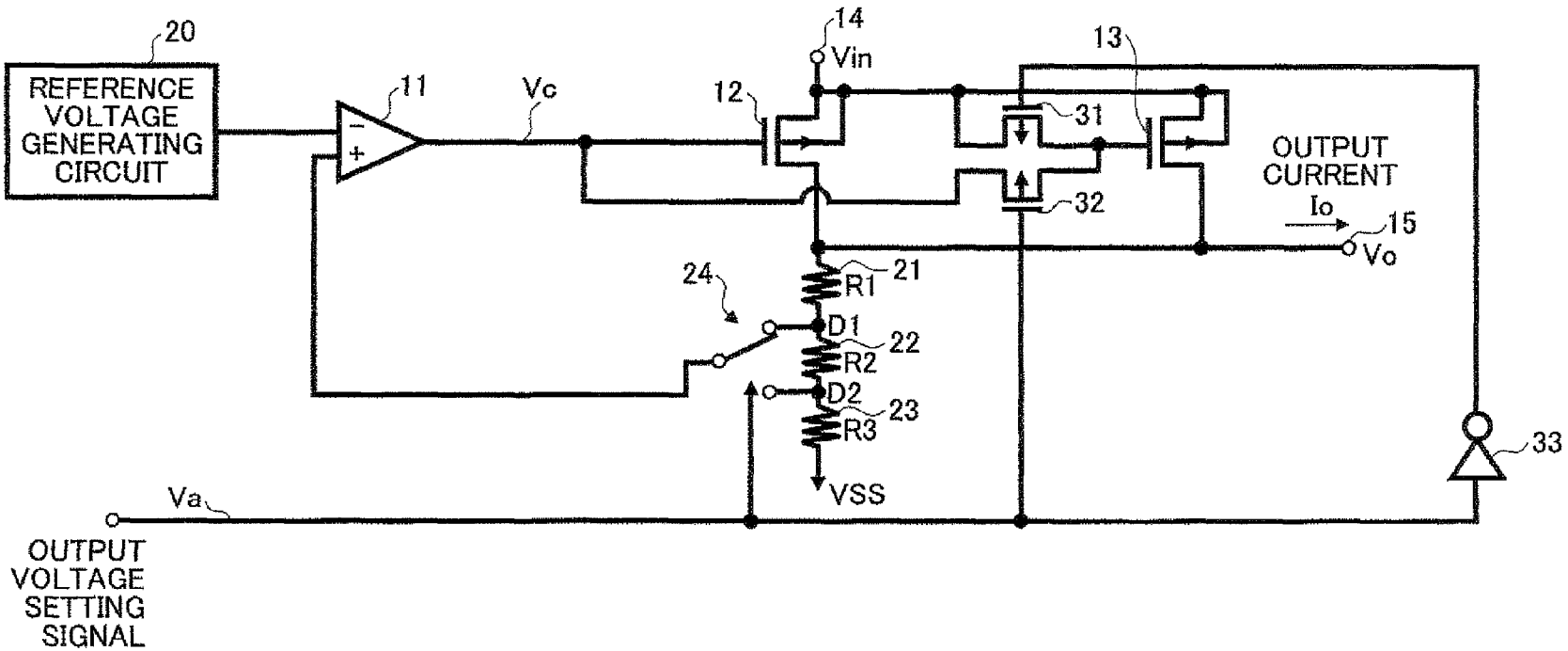
FIG. 7 is a drawing illustrating another example of the configuration of the series regulator circuit.

FIG. 7 is a drawing illustrating another example of the configuration of the series regulator circuit. In FIG. 7, the same elements as those of FIG. 5 are referred to by the same numerals, and a description thereof will be omitted. In the series regulator circuit illustrated in FIG. 7, PMOS transistors 31 and 32 and an inverter 33 are provided as the switch circuit in place of the PMOS transistor 27 serving as the switch circuit in FIG. 5.

When the output voltage setting signal Va is equal to the first value (i.e., LOW which is equal to the ground voltage VSS), the node D2 is selected so that VoR3/(R1+R2+R3) is supplied to the non-inverted input of the operational amplifier 11. In this case, the output voltage Vo is set equal to the high voltage Vo1 (e.g., 1.2 V). When the output voltage setting signal Va is equal to the second value (i.e., HIGH which is equal to the power supply voltage Vin), the node D1 is selected so that Vo(R2+R3)/(R1+R2+R3) is supplied to the non-inverted input of the operational amplifier 11. In this case, the output voltage Vo is set equal to the low voltage Vo2 (e.g., 0.8 V).

When the voltage setting of the output voltage Vo is Vo1 (e.g., 1.2 V), the output voltage setting signal Va is LOW, so that the PMOS transistors 31 and 32 become nonconductive and conductive, respectively. The PMOS transistors 12 and 13 are thus used to supply the output current Io to the output node 15. When the voltage setting of the output voltage Vo is Vo2 (e.g., 0.8 V), the output voltage setting signal Va is HIGH, so that the PMOS transistors 31 and 32 become conductive and nonconductive, respectively. Only the PMOS transistor 12 is thus used to supply the output current Io to the output node 15. A ratio of the gate width W1' of the PMOS transistor 12 to the gate width W2' of the PMOS transistor 13 may be set in the same manner as described in connection with FIG. 5.

Figure 8:
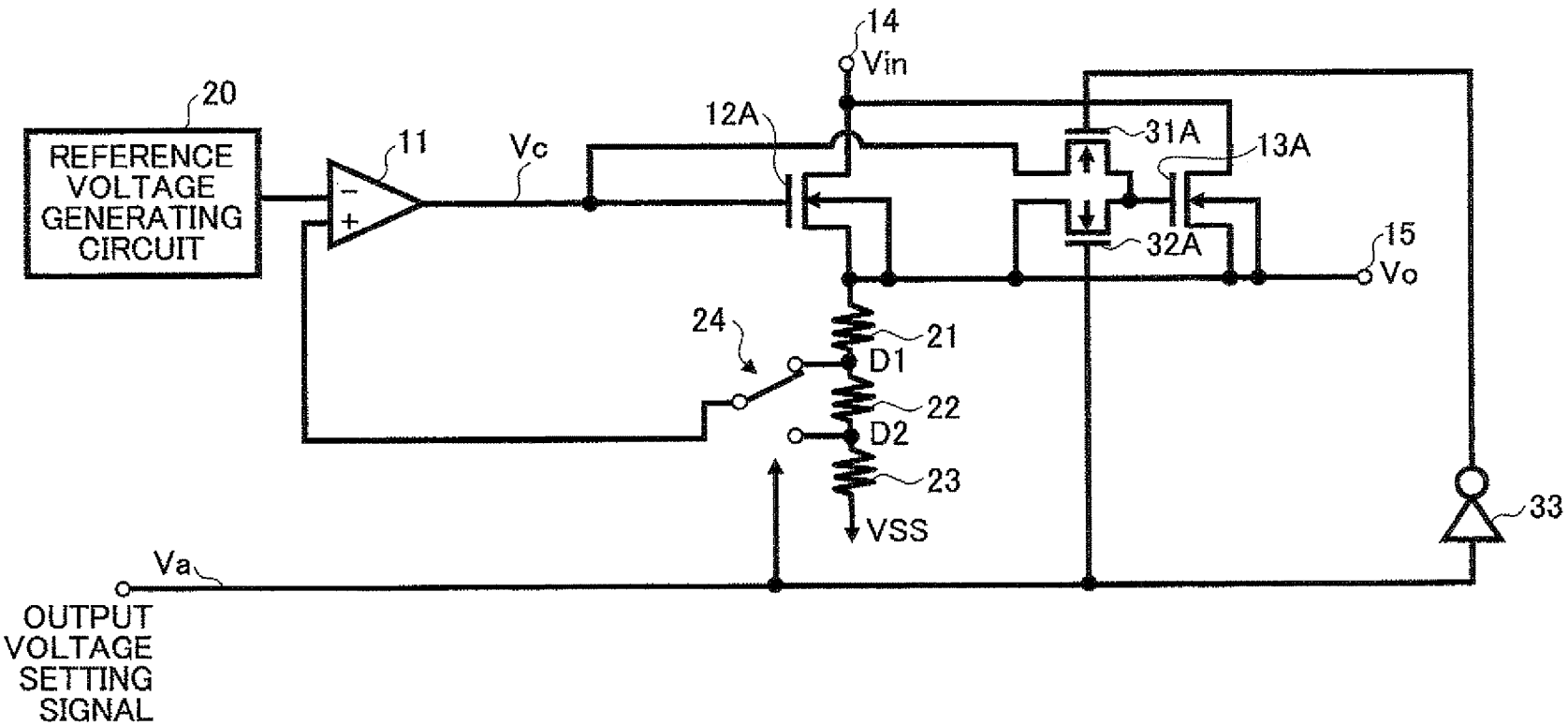
FIG. 8 is a drawing illustrating yet another example of the configuration of the series regulator circuit.

FIG. 8 is a drawing illustrating yet another example of the configuration of the series regulator circuit. In FIG. 8, the same elements as those of FIG. 7 are referred to by the same numerals, and a description thereof will be omitted. In the series regulator circuit illustrated in FIG. 8, NMOS transistors 12A and 13A are employed in place of the PMOS transistors 12 and 13 of FIG. 7, respectively.

When the voltage setting of the output voltage Vo is Vo1 (e.g., 1.2 V), the output voltage setting signal Va is LOW, so that NMOS transistors 31A and 32A become conductive and nonconductive, respectively. The NMOS transistors 12A and 13A are thus used to supply the output current Io to the output node 15. When the voltage setting of the output voltage Vo is Vo2 (e.g., 0.8 V), the output voltage setting signal Va is HIGH, so that the NMOS transistors 31A and 32A become nonconductive and conductive, respectively. Only the NMOS transistor 12A is thus used to supply the output current Io to the output node 15. The operations of the remaining circuit parts are the same as those in the configuration illustrated in FIG. 7.

As is described above, NMOS transistors may be employed as output transistors in place of PMOS transistors. A configuration that employs NMOS transistors as output transistors can be applicable to any series regulator circuit disclosed in the present application.

Figure 9:
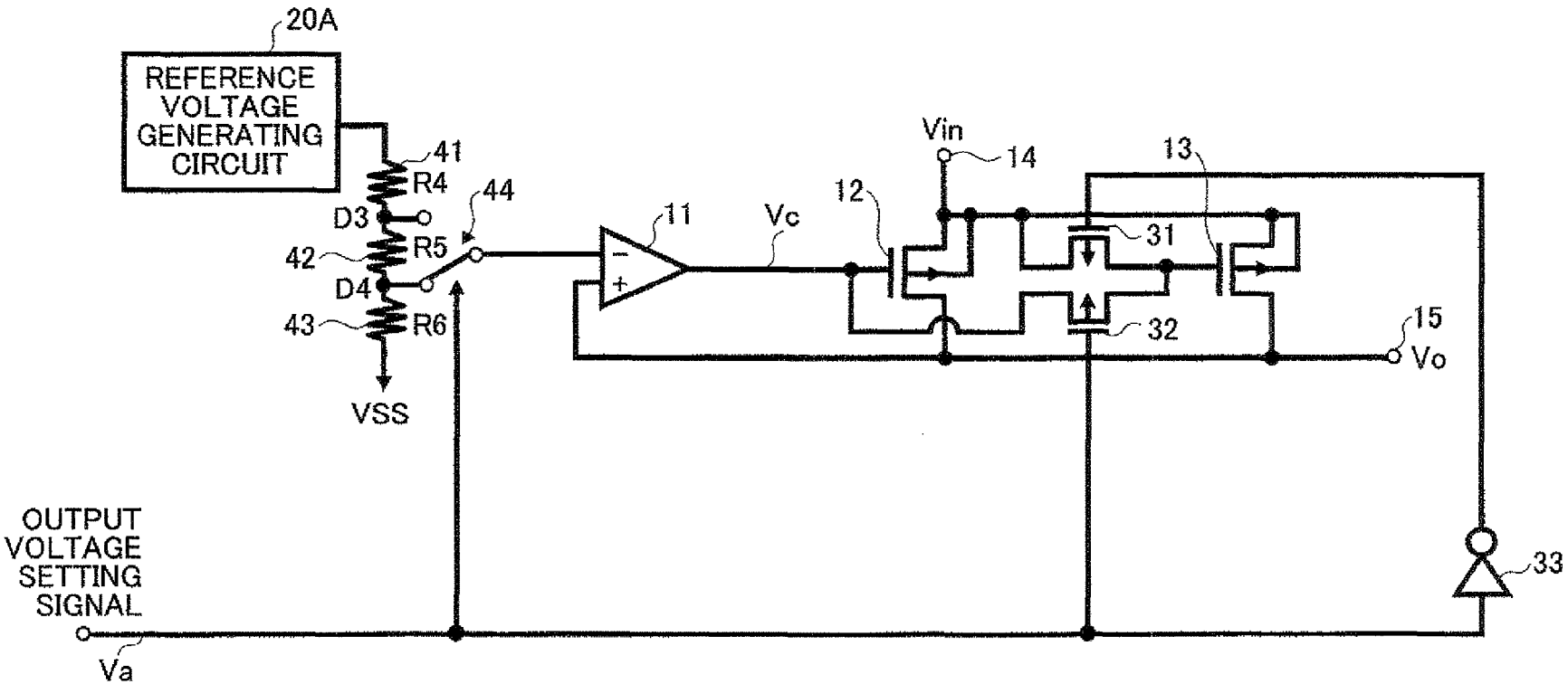
FIG. 9 is a drawing illustrating still another example of the configuration of the series regulator circuit.

FIG. 9 is a drawing illustrating still another example of the configuration of the series regulator circuit. In FIG. 9, the same elements as those of FIG. 7 are referred to by the same numerals, and a description thereof will be omitted. In the series regulator circuit illustrated in FIG. 7, a voltage generated by dividing the output voltage Vo is subjected to comparison. In the series regulator circuit illustrated in FIG. 9, on the other hand, the output voltage Vo is applied to the non-inverted input of the operational amplifier 11 as it is, and the inverted input of the operational amplifier 11 receives a voltage obtained by dividing the reference voltage generated by a reference voltage generating circuit 20A. A potential divider includes resistors 41 through 43 and a switch circuit 44. The resistors 41, 42, and 43 have resistance values R4, R5, and R6, respectively. The connection node of the switch circuit 44 is selectively coupled to either a node D3 or a node D4 in response to the output voltage setting signal Va, thereby supplying a selected divided voltage to the inverted input of the operational amplifier 11.

When the output voltage setting signal Va is equal to the first value (i.e., LOW which is equal to the ground voltage VSS), the node D3 is selected. In this case, the output voltage Vo is set equal to the high voltage Vo1 (e.g., 1.0 V). When the output voltage setting signal Va is equal to the second value (i.e., HIGH which is equal to the power supply voltage Vin), the node D4 is selected. In this case, the output voltage Vo is set equal to the low voltage Vo2 (e.g., 0.6 V). The operation of the switch circuit (i.e., the PMOS transistors 31 and 32 and the inverter 33) is the same as that of the configuration illustrated in FIG. 7. Since the resistors 41 through 43 of the potential divider is not provided on the negative feedback path of the operational amplifier 11, the resistance values R4 through R6 of the respective resistors 41 through 43 of the potential divider can be set to large values. This can reduce current consumption occurring in a potential divider compared with the configuration illustrated in FIG. 7.

Figure 10:
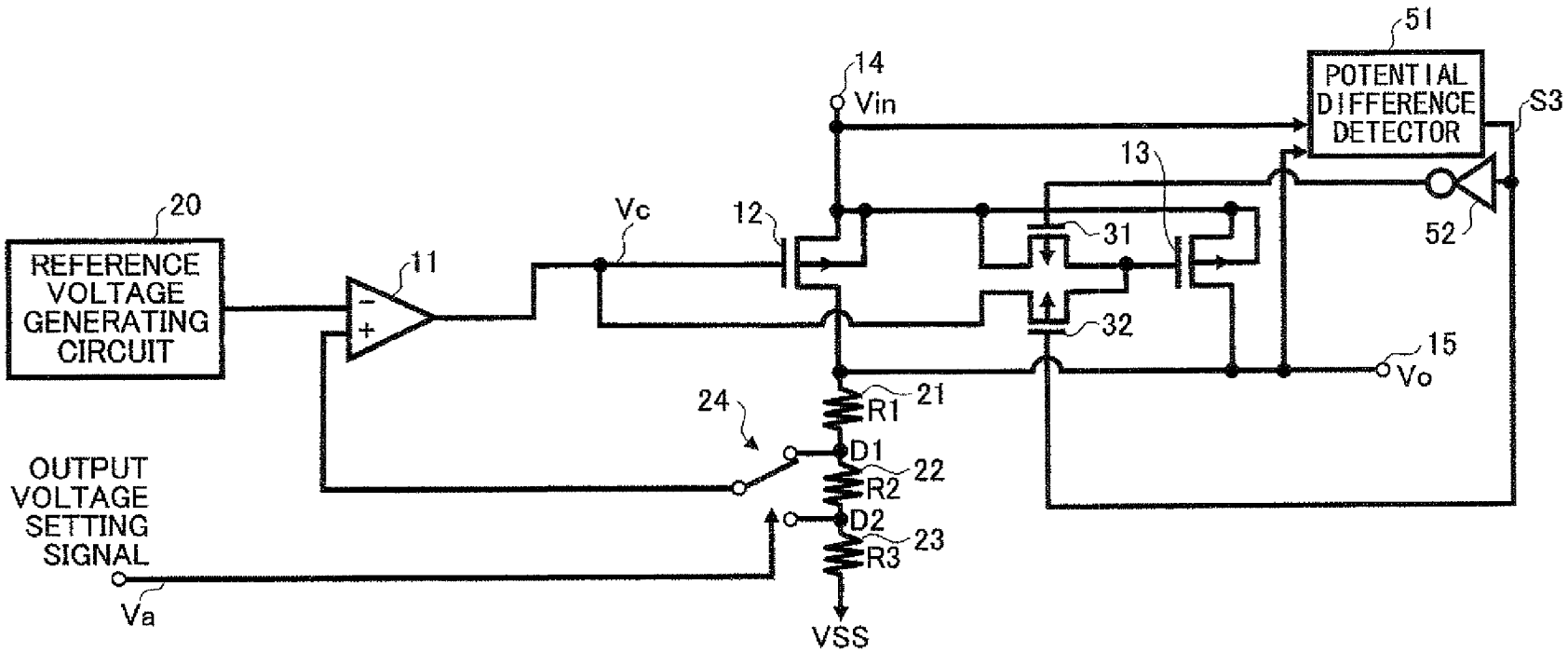
FIG. 10 is a drawing illustrating still another example of the configuration of the series regulator circuit.

FIG. 10 is a drawing illustrating still another example of the configuration of the series regulator circuit. In FIG. 10, the same elements as those of FIG. 7 are referred to by the same numerals, and a description thereof will be omitted. In the series regulator circuit illustrated in FIG. 7, the switch circuit is controlled in response to the output voltage setting signal Va in order to change the state of the switch circuit in conjunction with the voltage Vo of the output node 15. In the series regulator circuit illustrated in FIG. 10, a potential difference detector 51 generates a detection signal S3 responsive to the voltage Vo of the output node 15. This detection signal S3 is used to control the switch circuit. In the example illustrated in FIG. 10, the potential difference detector 51 detects a voltage difference between the input voltage Vin and the output voltage Vo. Alternatively, such an arrangement may be used as to detect a voltage difference between the ground voltage Vss and the output voltage Vo.

Figure 11:
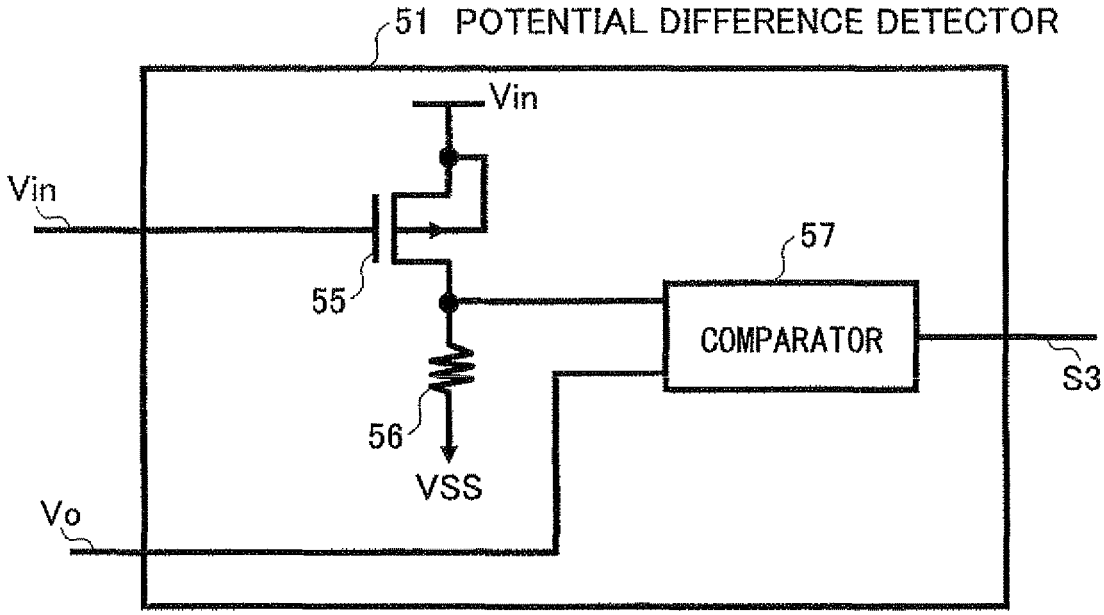
FIG. 11 is a drawing illustrating an example of the configuration of a potential difference detector.

FIG. 11 is a drawing illustrating an example of the configuration of the potential difference detector 51. The potential difference detector 51 includes a PMOS transistor 55, a resistor 56, and a comparator 57. The resistor 56 connects between the ground voltage VSS and the drain node of the PMOS transistor 55 having the gate node and source node thereof receiving Vin. The drain node of the PMOS transistor 55 is also coupled to one input of the comparator 57. The other input of the comparator 57 receives the output voltage Vo. The comparator 57 sets the detection signal S3 to LOW (i.e., VSS) when Vin−Vo is smaller than a reference value. The comparator 57 sets the detection signal S3 to HIGH (i.e., Vin) when Vin−Vo is larger than the reference value. The use of the PMOS source follower receiving Vin in the potential difference detector 51 makes it possible to detect an appropriate value responsive to manufacturing variation and temperature change.

The reference value is selected such that the detection signal S3 becomes LOW when the output voltage Vo is Vo1 (e.g., 1.2 V), and becomes HIGH when the output voltage Vo is Vo2 (e.g., 0.8 V). With the output voltage Vo being equal to Vo1, the PMOS transistor 31 becomes nonconductive, and the PMOS transistor 32 becomes conductive. The PMOS transistors 12 and 13 are thus used to supply the output current Io to the output node 15. With the output voltage Vo being equal to Vo2, the detection signal S3 is HIGH, so that the PMOS transistors 31 and 32 become conductive and nonconductive, respectively. Only the PMOS transistor 12 is thus used to supply the output current Io to the output node 15. The operations of the remaining circuit parts are the same as those in the configuration illustrated in FIG. 7.

Figure 12:
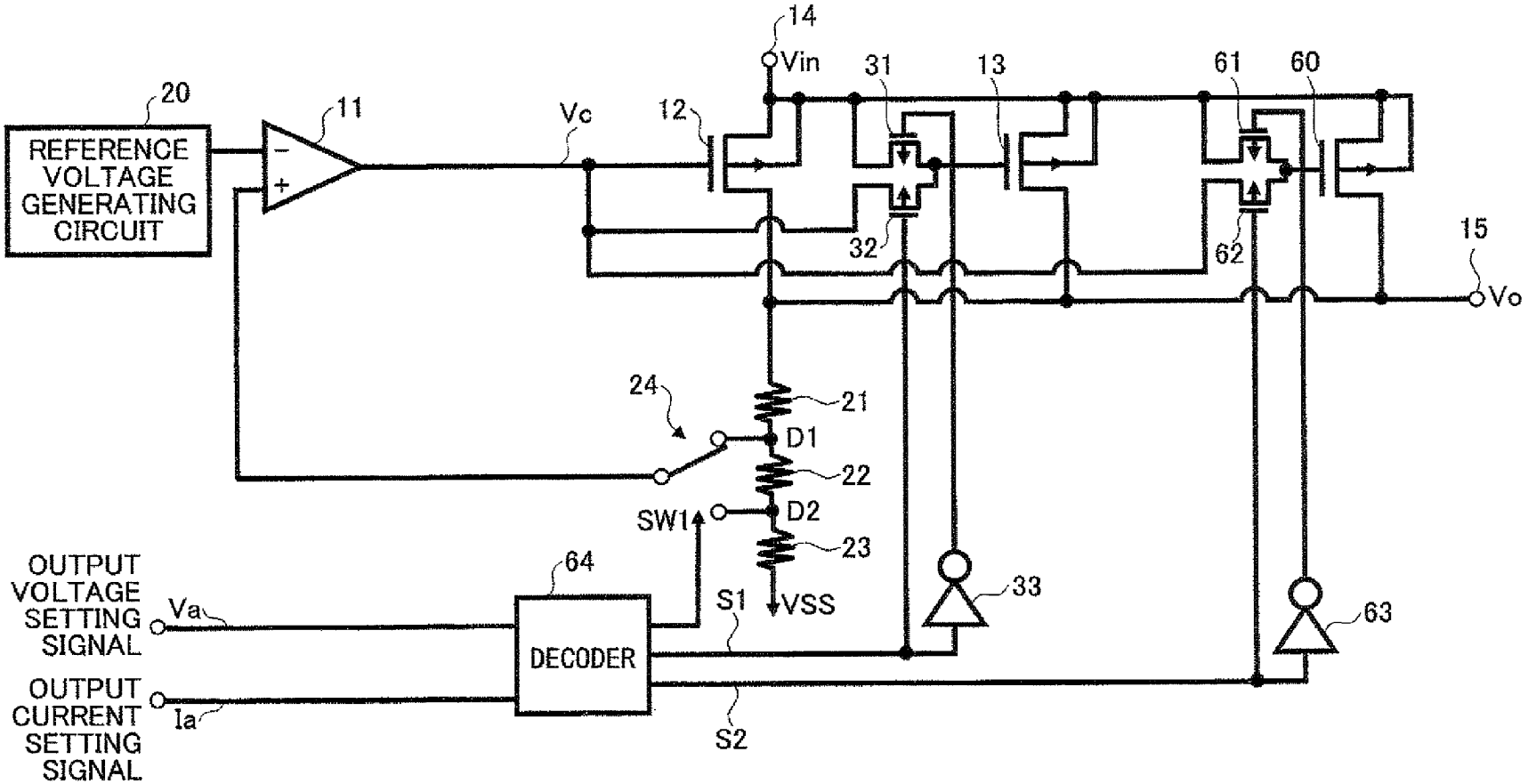
FIG. 12 is a drawing illustrating still another example of the configuration of the series regulator circuit.

FIG. 12 is a drawing illustrating still another example of the configuration of the series regulator circuit. In FIG. 12, the same elements as those of FIG. 7 are referred to by the same numerals, and a description thereof will be omitted. In the series regulator circuit illustrated in FIG. 12, a PMOS transistor 60 is provided in parallel to the PMOS transistor 13 of FIG. 7 as an additional output transistor. Similarly to the manner in which the PMOS transistors 31 and 32 and the inverter 33 are provided in FIG. 7, PMOS transistors 61 and 62 and an inverter 63 are provided for the purpose of controlling the switching operation of the PMOS transistor 60. A decode signal S1 controls whether the PMOS transistors 31 and 32 are conductive or nonconductive, and a decode signal S2 controls whether the PMOS transistors 61 and 62 are conductive or nonconductive. A decoder circuit 64 generates a signal SW1 for controlling the switch circuit 24 of the potential divider, and also generates the decode signals S1 and S2.

FIG. 13 is a table illustrating the decoding operations of the decoder circuit 64. The decoder circuit 64 receives the output voltage setting signal Va and an output current setting signal Ia. The decoder circuit 64 decodes Va and Ia to generate signals SW1, S1, and S2 as demonstrated in the table of FIG. 13. Output current setting values selectable by the output current setting signal Ia include a high current value and a low current value. Output voltage setting values selectable by the output voltage setting signal Va include 1.2 V and 0.8 V, for example. When the high current value and 1.2 V are selected, for example, SW1 is set to D2, so that the connection node of the switch circuit 24 is coupled to the node D2. Further, both S1 and S2 are set to VSS, so that the PMOS transistors 12, 13, and 60 are chosen as the transistors to supply an output current to the output node 15. When the low current value and 1.2 V are selected, for example, SW1 is set to D2, so that the connection node of the switch circuit 24 is coupled to the node D2. Further, S2 and S2 are set to VSS and Vin, respectively, so that the PMOS transistors 12 and 13 are chosen as the transistors to supply an output current to the output node 15.

In the manner described above, the switch circuit (i.e., the decoder circuit 64, the PMOS transistors 31 and 32, the inverter 33, the PMOS transistors 61 and 62, and the inverter 63) illustrated in FIG. 12 receives the output current setting signal Ia for setting an amount of current that is output from the output node 15. This switch circuit changes operating conditions, excluding the control voltage Vc, of the one or more transistors (i.e., PMOS transistors 12, 13, and 60) in conjunction with a change in the voltage setting of the output node 15. The switch circuit may further change an amount of output current supplied by the one or more transistors to the output node 15 in response to the output current setting signal Ia. Namely, the configuration illustrated in FIG. 13 is provided with an additional function to control the number of output transistors not only in response to the magnitude of the output voltage but also in response to the magnitude of the output current.

Figure 14:
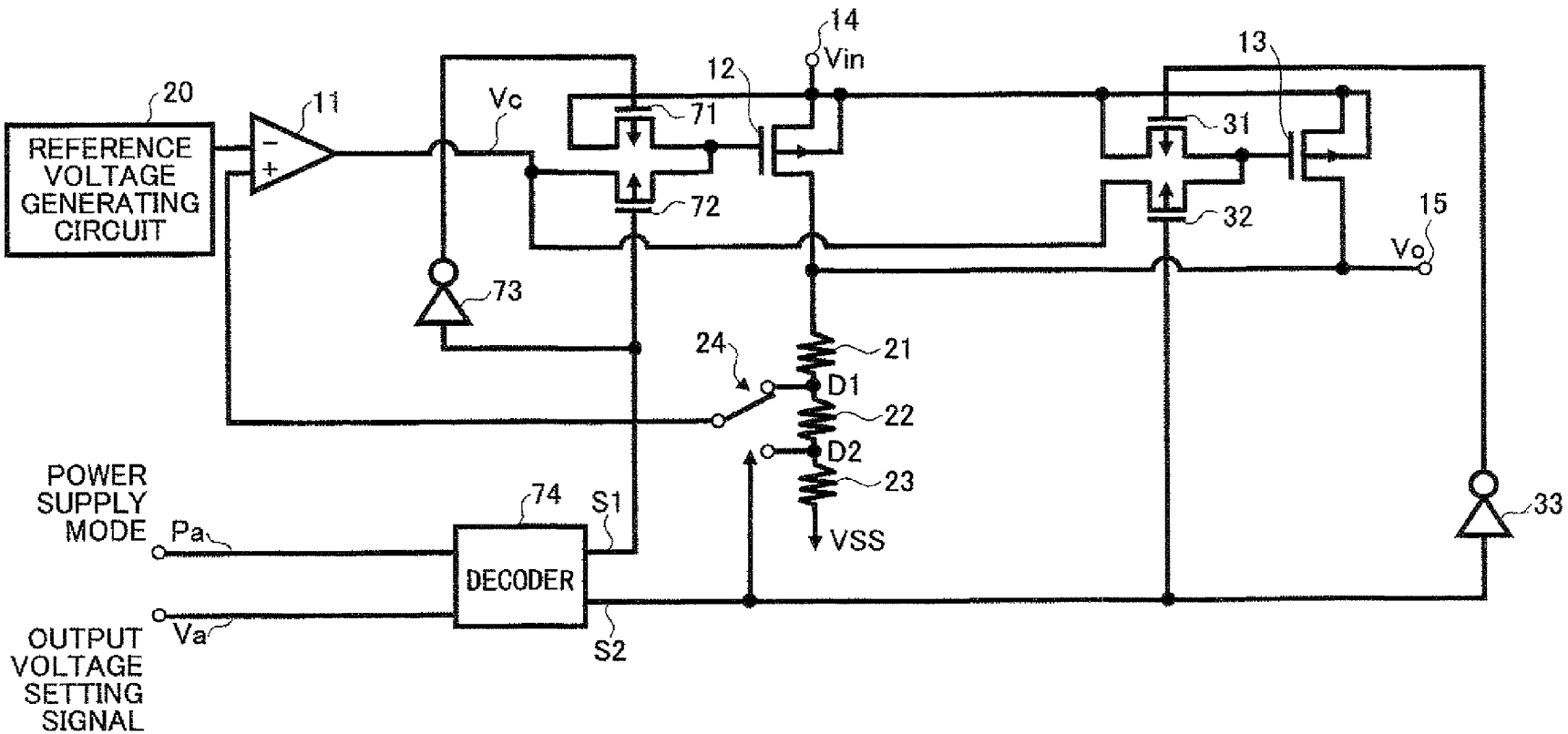
FIG. 14 is a drawing illustrating still another example of the configuration of the series regulator circuit.

FIG. 14 is a drawing illustrating still another example of the configuration of the series regulator circuit. In FIG. 14, the same elements as those of FIG. 7 are referred to by the same numerals, and a description thereof will be omitted. In the series regulator circuit illustrated in FIG. 14, the PMOS transistor 12 is also configured to be switchable. In order to control the switching operation, PMOS transistors 71 and 72 and an inverter 73 are provided similarly to the manner in which the PMOS transistors 31 and 32 and the inverter 33 of FIG. 7 are provided. A decode signal S1 controls whether the PMOS transistors 71 and 72 are conductive or nonconductive, and a decode signal S2 controls whether the PMOS transistors 31 and 32 are conductive or nonconductive. A decoder circuit 74 generates the decode signals S and S2. The decode signal S2 also controls the switch circuit 24 of the potential divider.

FIG. 15 is a table illustrating the decoding operations of the decoder circuit 74. The decoder circuit 74 receives the output voltage setting signal Va and a power supply mode signal Pa. The decoder circuit 74 decodes Va and Pa to generate the signals S1 and S2 as demonstrated in the table of FIG. 15. In this table, SW1 indicates the connection status of the switch circuit 24, the connection node of which may be controlled by the decode signal S2 as described above. Power supply modes indicated by the power supply mode signal Pa include a power-on mode and a power-off mode. Output voltage setting values selectable by the output voltage setting signal Va include 1.2 V and 0.8 V, for example. When the power supply mode signal Pa indicates the power-on state, the series regulator circuit illustrated in FIG. 14 operates in the same manner as the series regulator circuit illustrated in FIG. 7. When the power supply mode signal Pa indicates the power-off state, the series regulator circuit illustrated in FIG. 14 places the PMOS transistors 12 and 13 in the nonconductive state to set to zero the amount of output current supplied to the output node 15.

Figure 16:
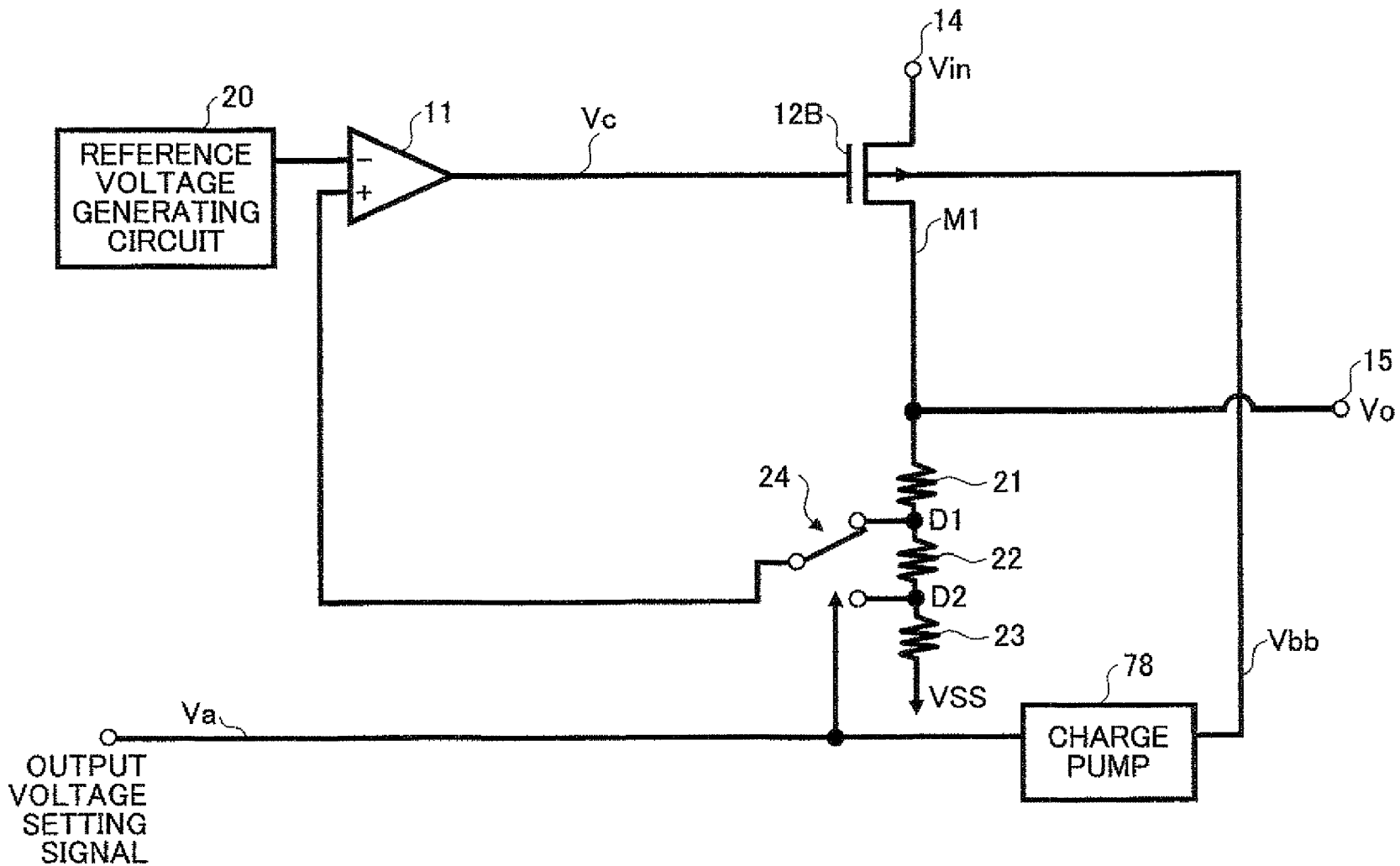
FIG. 16 is a drawing illustrating still another example of the configuration of the series regulator circuit.

FIG. 16 is a drawing illustrating still another example of the configuration of the series regulator circuit. In FIG. 16, the same elements as those of FIG. 7 are referred to by the same numerals, and a description thereof will be omitted. In the series regulator circuit illustrated in FIG. 16, a single PMOS transistor 12B is provided, with a charge pump 78 being used to control a well bias Vbb of the PMOS transistor 12B. In this configuration, the charge pump 78 serves as the switch circuit to change operating conditions, excluding the control voltage Vc, of the one or more transistors (i.e., PMOS transistor 12B in the example illustrated in FIG. 16) in conjunction with a change in the setting of a voltage value of the output node 15.

Specifically, the charge pump 78 is used to change the well-bias potential Vbb of the PMOS transistor 12B in response to the output voltage setting signal Va, thereby changing the threshold value of the transistor between the case of the output voltage setting signal Va being the first value and the case of the output voltage setting signal Va being the second value. In general, the greater the well bias of the transistor (i.e., the higher the potential Vbb of PMOS), the greater the transistor threshold is (i.e., the smaller the threshold potential of PMOS is). In consideration of this, the well-bias potential Vbb is set equal to a low potential, e.g., Vin, when the output voltage setting is high (e.g., 1.2 V). Moreover, the well-bias potential Vbb is set equal to a high potential, e.g., Vin+3 V, when the output voltage setting is low (e.g., 0.8 V). With this arrangement, the control voltage Vc can be maintained at the same voltage between the case of the output voltage setting being high (e.g., 1.2 V) and the case of the output voltage setting being low (e.g., 0.8 V).

Figure 17:
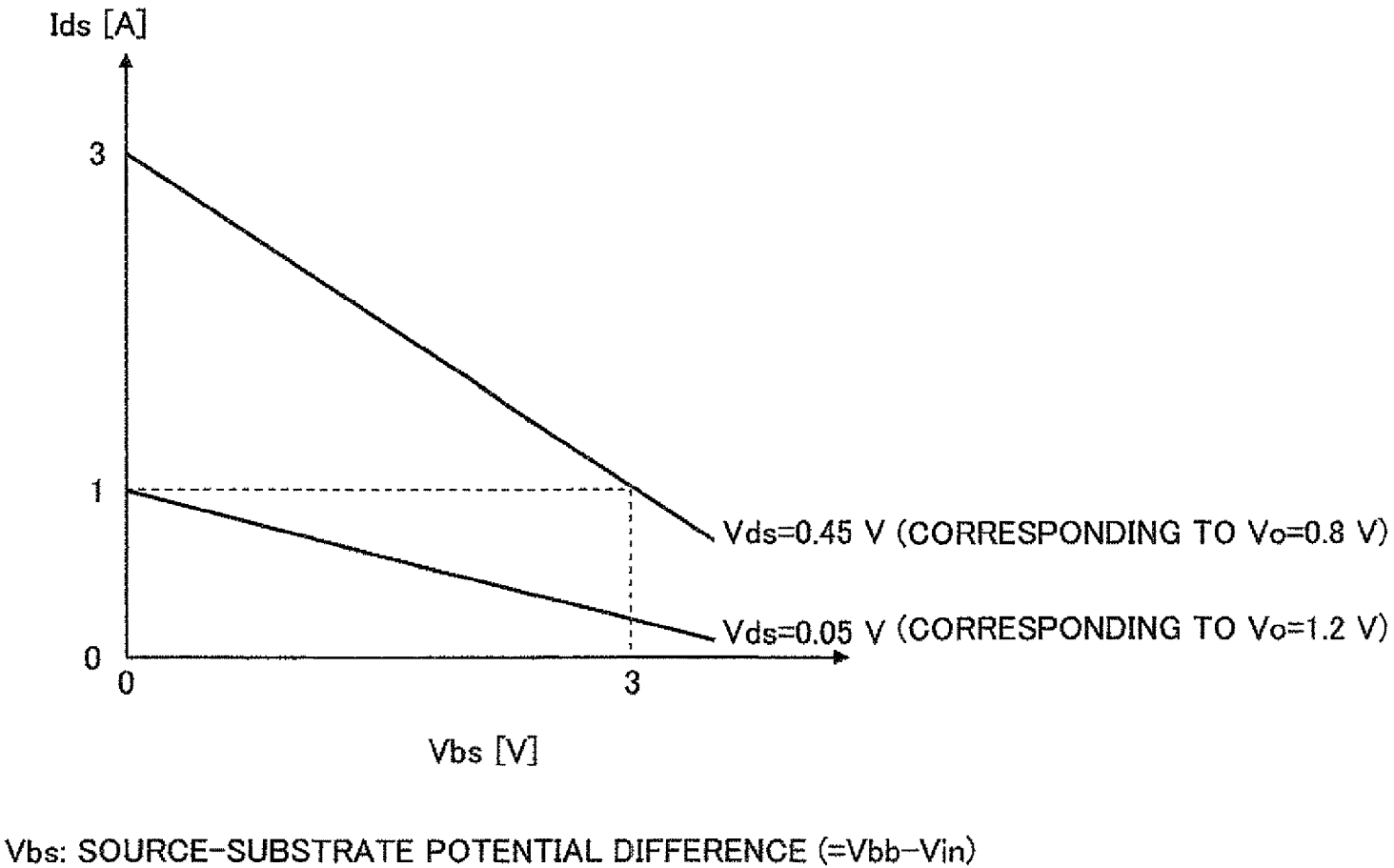
FIG. 17 is a drawing illustrating the Vds–Ids characteristics of a transistor.

FIG. 17 is a drawing illustrating the Vds–Ids characteristics of a transistor. The horizontal axis represents a source-substrate voltage Vbs (=Vbb–Vin), and the vertical axis represents a drain current Ids. The characteristics illustrated in FIG. 17 correspond to a case in which the gate voltage is kept constant. An increase in the well-bias potential Vbb (i.e., substrate potential in FIG. 17) causes the threshold voltage of the PMOS transistor 12B to be lowered, thereby decreasing the current Id for the fixed gate voltage. Namely, the drain current Ids exhibits a downward-sloping characteristic as illustrated in FIG. 17. Since the source voltage of the PMOS transistor 12B is Vin (=1.25 V), the characteristics observed in the case of the drain-source voltage Vds being 0.05 V correspond to the characteristics observed in the case of the output voltage Vo being 1.2 V. Further, the characteristics observed in the case of the drain-source voltage Vds being 0.45 V correspond to the characteristics observed in the case of the output voltage Vo being 0.8 V. In order to maintain the amount of the current Ids at 1 A despite a change in the output voltage Vo, Vbb may be set equal to Vin (i.e., Vbs=0 V) when the output voltage Vo is 1.2 V, and may be set equal to 3V+Vin (i.e., Vbs=3 V) when the output voltage Vo is 0.8 V.

The charge pump 78 may control the well-bias potential Vbb to satisfy the above-noted conditions, so that the control voltage Vc is substantially the same between the case of the output voltage Vo being Vo1 (e.g., 1.2 V) and the case of the output voltage Vo being Vo2 (e.g., 0.8V). Namely, the control voltage Vc is sustained at a low voltage level, thereby keeping a voltage difference between the gate and the source as large as possible.

Various examples of configurations have been heretofore described with respect to a series regulator circuit. These examples of configurations may be combined as appropriate. For example, the mechanism for power-on/off control based on a power supply mode illustrated in FIG. 14 and the mechanism for well-bias control illustrated in FIG. 16 may be combined. In such a combination, a switch circuit may be provided to fix the gate voltage of the PMOS transistor 12B illustrated in FIG. 16 to Vin in the power-off mode.

Figure 18:
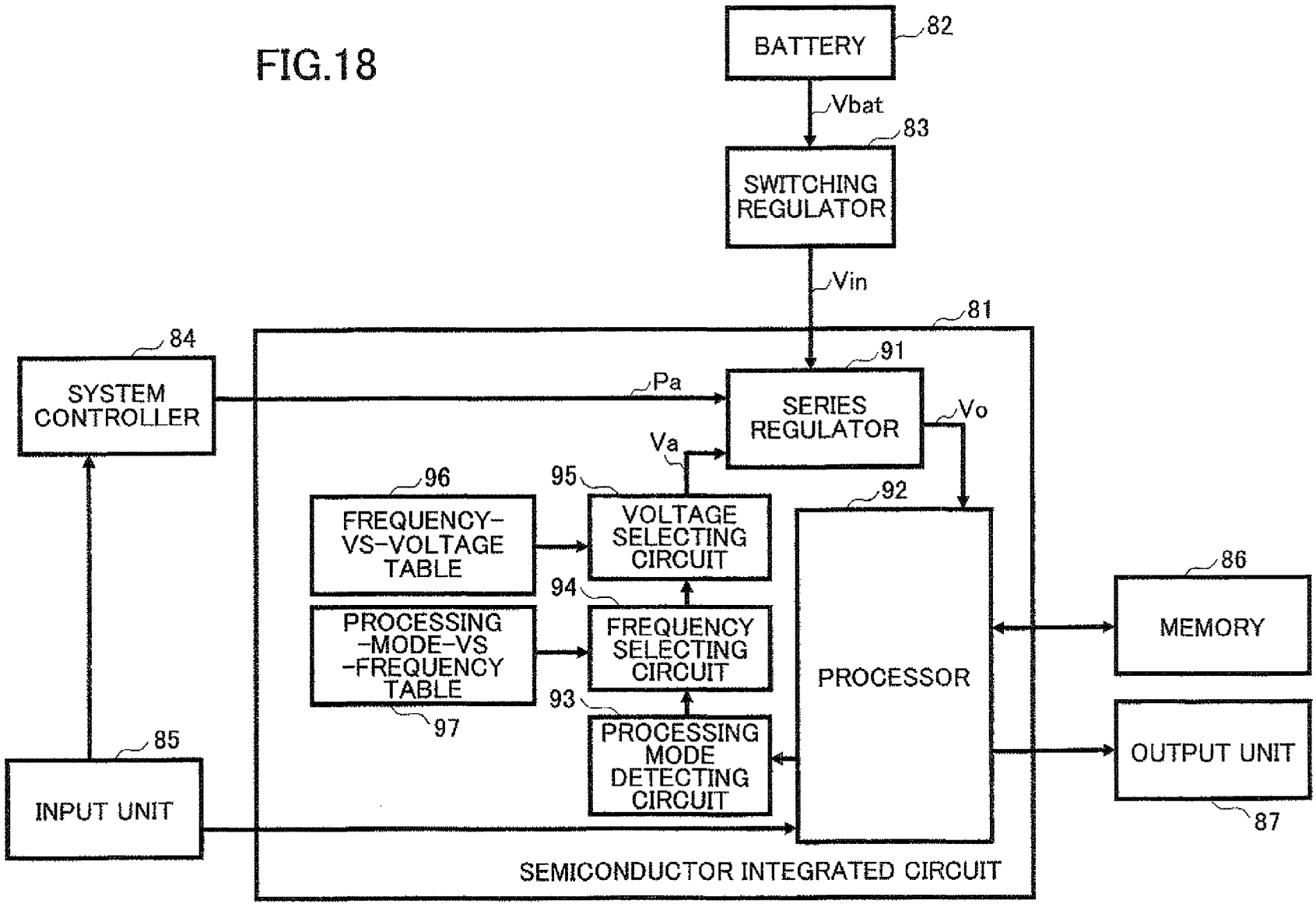
FIG. 18 is a drawing illustrating the configuration of a system which uses a semiconductor integrated circuit having the series regulator circuit embedded therein.

FIG. 18 is a drawing illustrating the configuration of a system which uses a semiconductor integrated circuit having the series regulator circuit embedded therein. The system of FIG. 18 includes a semiconductor integrated circuit 81, a battery 82, a switching regulator 83, a system controller 84, an input unit 85, a memory 86, and an output unit 87. The semiconductor integrated circuit 81 includes a series regulator 91 which is one of the series regulator circuits of the previously-described embodiments, and further includes a processor 92, a processing mode detecting circuit 93, a frequency selecting circuit 94, a voltage selecting circuit 95, a frequency-vs-voltage table 96, and a processing-mode-vs-frequency table 97.

The power-supply voltage (e.g., 2.5 V) output from the battery 82 is stepped down by the switching regulator 83 to Vin. The series regulator 91 receiving the output voltage Vin of the switching regulator 83 generates a stable output voltage Vo according to the operations as described in the above embodiments. The output voltage Vo produced at the output node of the series regulator 91 is supplied to the processor 92 as a power supply voltage. In order to provide Vo in the range of 0.8 V to 1.2 V, Vin is preferably set no lower than 1.25 V by taking into account a margin voltage of 0.05V. It is further desirable to set Vin equal to 1.25 V in order to reduce the power loss at the series regulator 91 to a minimum.

Upon receiving an instruction to use the processor 92, the input unit 85 requests the system controller 84 to set the power-supply mode of the processor 92 to the power-on mode. Further, the input unit 85 supplies an instruction and data specifying a process to be performed to the processor 92. The system controller 84 sends the mode signal Pa indicative of power-on to the series regulator 91. The series regulator 91 supplies an initial voltage value (e.g., 1.2 V) of Vo to the processor 92. The processor 92 performs the required process while exchanging data with the memory 86 in accordance with the instruction from the input unit 85.

The processor 92 has a plurality of processing modes, which include a first processing mode for use in the case of a heavy processing load and a second processing mode for use in the case of a light processing load. The processing mode in which the processor 92 is operating is detected by the processing mode detecting circuit 93. A signal indicative of the processing mode detected by the processing mode detecting circuit 93 is supplied to the frequency selecting circuit 94. The frequency selecting circuit 94 identifies a proper operating frequency by referring to the processing-mode-vs-frequency table 97 based on the signal indicative of the processing mode. A signal indicative of the identified operating frequency is supplied from the frequency selecting circuit 94 to the voltage selecting circuit 95. The voltage selecting circuit 95 identifies a proper operating voltage by referring to the frequency-vs-voltage table 96 based on the signal indicative of the operating frequency. A signal indicative of the identified operating voltage is supplied to the series regulator 91 as the output voltage setting signal Va. In response, the voltage Vo is set equal to 1.2 V in the case of the processing load of the processor 92 being heavy, and is set equal to 0.8 V in the case of the processing load of the processor 92 being light.

Upon completing the process, the processor 92 transmits data indicative of results of the process to the output unit 87. The output unit 87 outputs the received data indicative of results of the process in an output format such as a screen display format. Upon completing outputting, the processor 92 transmits a signal indicative of the completion of outputting to the system controller 84. In response, the system controller 84 sends the mode signal Pa indicative of power-off to the series regulator 91. In response to the mode signal Pa indicative of power-off, the series regulator 91 stops the supply of output current and voltage. With the power being suspended, the processor 92 is placed in a low-power-consumption state.

The configuration in which noise enters a control line supplying a control voltage to the control node of an output transistor has been described with reference to an example in which the control circuit to supply the control voltage is provided at a single location, and output transistors are provided at the perimeter of the chip. Such an arrangement is provided only for illustrative purposes, and the series regulator circuit disclosed herein is applicable to any arrangement of control circuits and output transistors.

According to at least one embodiment, one or more operating conditions, other than the control voltage, of the one or more transistors are changed in conjunction with a change in the voltage setting of the output node. With this arrangement, the control voltage applied to the one or more output transistors to provide a constant output current regardless of an output voltage setting can be maintained at a constant voltage level at which the influence of noise is relatively small. Namely, a voltage difference between the gate and the source can be kept as large as possible. Fluctuation in the output voltage can thus be kept small even when the control voltage fluctuates due to capacitive coupling and the like.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A series regulator circuit, comprising:

one or more transistors each having a channel with one end coupled to an input node to receive an input voltage and another end coupled to an output node, and having a control node to receive a control voltage;

a control circuit configured to adjust the control voltage in response to a voltage of the output node such that the voltage of the output node is set equal to a voltage setting selected by an output voltage setting signal; and a switch circuit, coupled between the another end of one or more transistors and the output node, configured to change an operating condition, excluding the control voltage, of the one or more transistors in conjunction with a change in the voltage setting of the output node;

wherein the control circuit sets a reference voltage for adjusting the control voltage based on the output voltage setting signal.

2. The series regulator circuit as claimed in claim 1, wherein a change in the control voltage required to supply a constant current to the output node regardless of a change in the voltage setting of the output node upon changing the operating condition of the one or more transistors is made smaller than a change in the control voltage required to supply a constant current to the output node regardless of a change of the output node without changing the operating condition of the one or more transistors.

3. The series regulator circuit as claimed in claim 1, wherein the switch circuit is configured to change the operating condition of the one or more transistors in response to the output voltage setting signal.

4. The series regulator circuit as claimed in claim 1, further comprising a voltage detector configured to generate a detection signal responsive to the voltage of the output node, wherein the switch circuit is configured to change the operating condition of the one or more transistors in response to the detection signal.

5. The series regulator circuit as claimed in claim 1, wherein the switch circuit is configured to choose a first transistor from the one or more transistors to supply a current to the output node in a case of the output voltage setting signal being a first value and to choose a second transistor different from the first transistor from the one or more transistors to supply a current to the output node in a case of the output voltage setting signal being a second value.

6. The series regulator circuit as claimed in claim 1, wherein the switch circuit is configured to use a first number of transistors chosen from the one or more transistors to supply a current to the output node in a case of the output voltage setting signal being a first value and to choose a second number of transistors chosen from the one or more transistors to supply a current to the output node in a case of the output voltage setting signal being a second value, the first number being different from the second number.

7. The series regulator circuit as claimed in claim 1, wherein the switch circuit is configured to change a well bias potential of the one or more transistors to change a threshold value of the one or more transistors between a case of the output voltage setting signal being a first value and a case of the output voltage setting signal being a second value.

8. The series regulator circuit as claimed in claim 1, wherein the switch circuit is configured to receive an output current setting signal for setting an amount of current output from the output node, and is configured to change the operating condition of the one or more transistors in conjunction with a change of the output node and to change an amount of current supplied from the one or more transistors to the output node in response to the output current setting signal.

9. A series regulator circuit, comprising:

a switching regulator; and a series regulator configured to receive as an input voltage an output voltage of the switching regulator, wherein the series regulator includes:

one or more transistors each having a channel with one end coupled to an input node to receive the input voltage and another end coupled to an output node, and having a control node to receive a control voltage;

a control circuit configured to adjust the control voltage in response to a voltage of the output node such that the voltage of the output node is set equal to a voltage setting selected by an output voltage setting signal; and a switch circuit, coupled between the another end of one or more transistors and the output node, configured to change an operating condition, excluding the control voltage, of the one or more transistors in conjunction with a change in the voltage setting of the output node;

wherein the control circuit sets a reference voltage for adjusting the control voltage based on the output voltage setting signal.

10. A semiconductor integrated circuit, comprising:

a processor configured to operate in one of a plurality of processing modes; and a series regulator configured to supply a power supply voltage to the processor, wherein the series regulator includes:

one or more transistors each having a channel with one end coupled to an input node to receive an input voltage and another end coupled to an output node, and having a control node to receive a control voltage;

a control circuit configured to adjust the control voltage in response to a voltage of the output node such that the voltage of the output node is set equal to a voltage setting responsive to a signal indicating the one of the plurality of processing modes; and a switch circuit, coupled between the another end of one or more transistors and the output node, configured to change an operating condition, excluding the control voltage, of the one or more transistors in conjunction with a change in the voltage setting of the output node, wherein the power supply voltage is supplied from the output node to the processor;

wherein the control circuit sets a reference voltage for adjusting the control voltage based on the output voltage setting signal.

11. A series regulator circuit, comprising:

one or more transistors each having a channel with one end coupled to an input node to receive an input voltage and another end coupled to an output node, and having a control node to receive a control voltage;

a control circuit configured to adjust the control voltage in response to a voltage of the output node such that the voltage of the output node is set equal to a voltage setting selected by an output voltage setting signal; and a switch circuit, coupled between an input of the control circuit and the output node, configured to change an operating condition, excluding the control voltage, of the one or more transistors in conjunction with a change in the voltage setting of the output node; and a voltage divider configured to divide the voltage of the output node based on the output voltage setting signal to supply the divided voltage to the control circuit.

12. The series regulator circuit as claimed in claim 11, wherein a change in the control voltage required to supply a constant current to the output node regardless of a change in the voltage setting of the output node upon changing the operating condition of the one or more transistors is made smaller than a change in the control voltage required to supply a constant current to the output node regardless of a change of the output node without changing the operating condition of the one or more transistors.

13. The series regulator circuit as claimed in claim 11, wherein the switch circuit is configured to change the operating condition of the one or more transistors in response to the output voltage setting signal.

14. The series regulator circuit as claimed in claim 11, further comprising a voltage detector configured to generate a detection signal responsive to the voltage of the output node, wherein the switch circuit is configured to change the operating condition of the one or more transistors in response to the detection signal.

15. The series regulator circuit as claimed in claim 11, wherein the switch circuit is configured to choose a first transistor from the one or more transistors to supply a current to the output node in a case of the output voltage setting signal being a first value and to choose a second transistor different from the first transistor from the one or more transistors to supply a current to the output node in a case of the output voltage setting signal being a second value.

16. The series regulator circuit as claimed in claim 11, wherein the switch circuit is configured to use a first number of transistors chosen from the one or more transistors to supply a current to the output node in a case of the output voltage setting signal being a first value and to choose a second number of transistors chosen from the one or more transistors to supply a current to the output node in a case of the output voltage setting signal being a second value, the first number being different from the second number.

17. The series regulator circuit as claimed in claim 11, wherein the switch circuit is configured to change a well bias potential of the one or more transistors to change a threshold value of the one or more transistors between a case of the output voltage setting signal being a first value and a case of the output voltage setting signal being a second value.

18. The series regulator circuit as claimed in claim 11, wherein the switch circuit is configured to receive an output current setting signal for setting an amount of current output from the output node, and is configured to change the operating condition of the one or more transistors in conjunction with a change of the output node and to change an amount of current supplied from the one or more transistors to the output node in response to the output current setting signal.

* * * * *